US008581132B2

(12) United States Patent
Borgwarth et al.

(10) Patent No.: US 8,581,132 B2
(45) Date of Patent: Nov. 12, 2013

(54) TACTICAL SHORTING PLUG

(75) Inventors: Dennis W. Borgwarth, Andover, MN (US); Juleigh Perona, Fridley, MN (US); Randall J. Appleton, West St. Paul, MN (US)

(73) Assignee: BAE Systems Land & Armaments, L.P., Santa Clara, CA (US)

( * ) Notice: Subject to any disclaimer, the term of this patent is extended or adjusted under 35 U.S.C. 154(b) by 249 days.

(21) Appl. No.: 13/101,829

(22) Filed: May 5, 2011

(65) Prior Publication Data

US 2012/0279842 A1 Nov. 8, 2012

(51) Int. Cl.
*H01H 19/20* (2006.01)

(52) U.S. Cl.
USPC ..... 200/568

(58) Field of Classification Search
USPC ..... 200/568, 564, 51.17, 17 R, 19.02, 19.03, 200/19.07, 19.13, 19.18, 19.2, 36–38 R, 200/33 B, 50.28–50.34, 51 R, 416, 538–542, 200/558, 336; 439/188, 511, 507
See application file for complete search history.

(56) References Cited

U.S. PATENT DOCUMENTS

| | | | | |
|---|---|---|---|---|
| 3,035,244 | A | 5/1962 | Aveni | |
| 3,213,407 | A | 10/1965 | Thomas et al. | |
| 3,259,968 | A | 7/1966 | Dyksterhouse | |
| 3,568,136 | A | 3/1971 | Wells | |
| 3,743,915 | A * | 7/1973 | Struck | 320/127 |

(Continued)

FOREIGN PATENT DOCUMENTS

| | | | |
|---|---|---|---|
| JP | 2009146779 | A | 7/2009 |
| JP | 2009231708 | A | 10/2009 |
| WO | WO 2010/037424 | A1 | 4/2010 |

OTHER PUBLICATIONS

Written Opinion and International Search Report for PCT Application No. PCT/US2012/031805, filed Apr. 2, 2012 (mailed Oct. 19, 2012) (8 pgs.).

*Primary Examiner* — Edwin A. Leon
*Assistant Examiner* — Anthony R. Jimenez
(74) *Attorney, Agent, or Firm* — Patterson Thuente Pedersen, P.A.

(57) ABSTRACT

A shorting plug for a pulsed power system is provided, having a rotator assembly at least partially nested within a cam housing and at least partially rotatable within the cam housing with respect to a cam rail that operably engages the rotator assembly to transition between a shorted mode of operation and an open mode of operation. During the shorted mode of operation, a pair of electrical contacts extend from the cam housing to operably engage the electrical contacts electrically connected to a energy storage device such as a capacitor, while the electrical contacts are retracted and rotated within the cam housing during the open mode of operation. The rotator assembly is connected to a housing cap, which allows the operator to transition the shorting plug between the two modes of operation. The shorting plug also contains a first latch mechanism that operably engages the housing cap during the shorted mode of operation, and a second latch mechanism that operably engages the housing during the open mode of operation. During transition between the shorted and open modes of operation, a vertical load, a horizontal load and a rotational load are applied by the operator to overcome the horizontal load and rotational locking mechanism provided by the first and second latch mechanisms, a downward vertical load applied to the rotator assembly that operably engages the cam rail, and the cam rail that provides a rotational limit of the rotator assembly without an upward vertical load being applied.

27 Claims, 13 Drawing Sheets

(56) References Cited

U.S. PATENT DOCUMENTS

| | | | | | |
|---|---|---|---|---|---|
| 3,905,667 | A | | 9/1975 | Crimmins et al. | |
| 4,090,667 | A | | 5/1978 | Crimmins | |
| 4,120,552 | A | * | 10/1978 | Winkler et al. | 439/95 |
| 4,703,986 | A | * | 11/1987 | McCormick | 439/607.12 |
| 5,083,299 | A | | 1/1992 | Schwanke et al. | |
| 5,476,485 | A | | 12/1995 | Weinberg et al. | |
| 6,986,686 | B2 | | 1/2006 | Shibata et al. | |
| 7,153,157 | B2 | | 12/2006 | Robinson et al. | |
| 7,476,113 | B2 | * | 1/2009 | Tamagawa et al. | 439/189 |
| 7,651,366 | B2 | | 1/2010 | Ringler et al. | |
| 7,686,645 | B2 | | 3/2010 | Aikins et al. | |
| 7,833,050 | B2 | | 11/2010 | Aikins et al. | |
| 8,002,587 | B2 | | 8/2011 | Fleisig | |
| 2006/0160413 | A1 | | 7/2006 | Robinson et al. | |
| 2008/0268714 | A1 | | 10/2008 | Bump | |
| 2008/0318467 | A1 | | 12/2008 | Denomme et al. | |

* cited by examiner 10
20
90

43
140
28
89
20
65
80a
88
80b
76
74
60
72
70
30
31
54b
54a
90

90
108
106
104
102
91a
110
93
92
94

90
108
106
110
112
114
A
A'
97
99
93

90
112
93
114
116
118
94
91b
92

90
91a
102
132
130
128
94
99
93
92

90
91a
94
130
128
126
91b
122
124
93

90
93
126
118
120
122
124

10
20
24
22
90
80a
98

10
40
30
60
80a
80b
76

10
76
60
80a
90
54b
98
54a

TACTICAL SHORTING PLUG

FIELD OF INVENTION

The present invention relates to a safety apparatus for the electrical shorting of an electrical circuit or electrical energy storage device. More particularly, the present invention is directed to an environmentally robust shorting plug for safely shorting a pulsed power circuit, wherein the shorting plug is capable of containing within the pulsed power circuit the entire discharged stored energy that may be retained on a fully charged electrical storage device when the shorting plug is engaged in a shorting condition by dissipating the energy throughout the entire energy storage device.

BACKGROUND OF THE INVENTION

Invariably with any electrical circuit is associated the danger of electric shock when working on the electrical circuit for maintenance service. This is especially the case when the electrical circuit contains high voltage capacitors such as used in industry or research that can inadvertently retain sufficient electrical charge that can be harmful or even lethal. Various safety devices and procedures have been developed to reduce or eliminate electric shock.

In the past few years, there has been considerable improvement in the area of pulsed power research, which involves storing, shaping, performance of high energy density capacitors used in pulsed power applications. Pulsed power applications pertain to numerous areas including at least laser drivers, high power microwave generators, particle accelerators, nuclear fusion, electromagnetic mass drivers, medical equipment, and industrial manufacturing technology. High pulsed power systems with capacitors capable of energy in the 10 kV and 150,000 A range have also found military applications, including in current military vehicles and future combat systems. The requirements for components in pulsed power applications in military applications are more taxing that that of other market segments due to the systems being mobile rather than fixed emplacements, the systems operating in hostile environments rather than controlled climate laboratories, the systems requiring more periodic maintenance service, which needs to be quick and efficient without affecting safety, and the systems having other criteria requirements such as size and weight constraints, as well as performance criteria.

Whether provided in a controlled environment as fixed emplacements or in a hostile environment as a mobile system, there is often the need for maintenance service of a pulsed power system and the need to short-circuit the electrical circuit during such service to make this maintenance safe for the operator. Current devices and methods of providing a short-circuit to the pulsed power system often require laborious efforts that are time consuming, require additional tools and are inefficient. Thus, there is a need for short-circuiting pulsed power systems in a safe, efficient, effective and timely manner. In mobile military applications, the need for short-circuiting pulsed power systems also must be able to survive the tactical environment, including for instance, shock, vibration, rain, dust, water immersion, and humidity, be able to meet size, weight, and visual indication criteria, and also be able to meet performance requirements. There is also the need for a shorting plug that can fit current pulsed power systems.

BRIEF SUMMARY OF THE INVENTION

It is therefore an object of the present invention to provide a shorting plug to provide a direct short of the internal electrical storage device of a pulsed power system that is of simple construction, easily operated, able to be operated in a quick and timely manner, visually indicative of the shorting plug state to the operator, robust to a hostile environment, and safe to use even if the entire storage capacitor energy of the pulsed power system is discharged through the shorting plug by an operator that accidently engages the shorting plug in a shorting condition while the pulsed power system is fully charged.

It is also an object of the present invention to provide a shorting plug that can be used on mobile pulsed power systems that are able to meet size, weight and other physical criteria, as well as performance requirements.

Other objects and advantages of the present invention will hereinafter become more fully apparent to one of ordinary skill in the art based upon the brief description of the drawings and detailed written description.

In one aspect, the present invention relates to a shorting plug for a pulsed power system having a cam housing containing a cam rail that operably engages a rotator assembly with a pair of short-circuiting electrodes electrically connected by a current bridging bar, the rotator assembly being partially nested within the cam housing and at least partially rotatable therein such that the rotator assembly is capable of rotationally engaging with the cam rail between a shorted mode of operation with short-circuiting electrodes extending from the cam housing and an open mode of operation with the short-circuiting electrodes retracted within the cam housing. The shorting plug also contains a first latch mechanism that operably engages a housing cap connected to the rotator assembly during the shorted mode of operation, and a second latch mechanism operably engages the housing during the open mode of operation. The shorting plug also contains a vertical, horizontal and rotational load to be applied by the operator to transition between the shorted mode of operation and the open mode of operation. When applied these three loads overcome the horizontal load provided by each of the first and second latch mechanisms, rotational locking mechanism provided by each of the first and second latch mechanisms, a downward vertical load applied to the rotator assembly that operably engages the cam rail, and the cam rail that provides a rotational limit between the different modes of operation without first applying an upward vertical load.

In one aspect, the shorting plug has a rotator assembly having a rotator with a bottom section and a top section, a current bridging bar contained within an aperture in the bottom section, and a first electrode and a second electrode electrically connected by the current bridging bar, a cap housing comprising a cylindrical sidewall connected to a top portion, and the top portion of the rotator connected to the top section of the rotator, a cam housing having a bottom portion with a first electrode aperture and a second electrode aperture, a top flange with an actuation aperture, and a cylindrical sidewall with a distal end and a proximal end, the distal end connected to the bottom portion and the proximal end connected to the top flange, and the bottom section of the rotator contained within the cam housing and the top section of the rotator at least partially extending through the actuation aperture, and a cam rail located within the cam housing proximate the cylindrical side wall. The cam rail has at least a first section, a second section, and a third section, the second section located between the first section and the third section, the second section located a first vertical distance away from the first section, and the second section located a second vertical distance away from the third section. In this aspect, the bottom portion of the rotator is capable of operably engaging the cam rail and at least partially rotating within the cam housing between the first section, second section, and third section of the cam rail and the first electrode is capable of extending from the first electrode aperture and the second electrode is capable of extending from the second electrode aperture when the rotator is operably engaged with the first section of the cam rail, and the first and second electrodes are capable of being retracted within the cam housing when the rotator is operably engaged with the second or third sections of the cam rail.

In another aspect, the shorting plug comprises a spring located between the top flange and the bottom section of the rotator around at least a portion of the top section of the rotator, the spring providing a downward vertical force on the rotator assembly towards the bottom portion of the cam housing.

In another aspect, the shorting plug of claim comprises at least one latch mechanism connected to the top flange outside the cam housing, the latch mechanism capable of operably engaging a window located in the cylindrical sidewall of the cap housing.

In another aspect, the shorting plug of claim comprises a first latch connected to the top flange outside the cam housing at a first position, and a second latch connected to the top flange outside the cam housing at a second position. The first latch operably engages a window located in the cylindrical sidewall of the cap housing when the rotator is operably engaged with the first section of the cam rail, and the second latch operably engages the window located in the cylindrical sidewall of the cap housing when the rotator is operably engaged with the third section of the cam rail.

In another aspect, the first latch and the second latch do not operably engage the window located in the cylindrical sidewall of the cap housing when the rotator is operably engaged with the second section of the cam rail.

In another aspect, the first latch has a first visual indicator that indicates to an operator that the shorting plug is in a shorted mode of operation. The second latch has a second visual indicator that indicates to the operator that the shorting plug is in an open mode of operation.

In another aspect, the first latch is located at a first position on the cam housing, which is in a different horizontal plane than the second latch located at a second position on the cam housing.

In another aspect, the first latch has a slot portion such that when the first latch operably engages the window of the cap housing, the slot portion is capable of operably receiving a portion of the cylindrical sidewall within the slot portion. In another aspect, the second latch has a slot portion such that when the second latch operably engages the window of the cap housing, the slot portion is capable of operably receiving a portion of the cylindrical sidewall within the slot portion.

In another aspect, the latches are operably connected to springs, which provide a horizontal force on the respective latch in a direction extending away from the shorting plug, or more particularly the rotator and/or top flange. In another aspect, the springs operably engage the respective latch and either the top flange or the rotator.

In another aspect, the shorting plug contains a spring located between the top flange and the bottom section of the rotator around at least a portion of the top section of the rotator, the spring providing a downward vertical force on the rotator assembly towards the bottom portion of the cam housing.

In another aspect, the cam rail contains at least three sections, each of the three sections having different vertical distances away from the bottom portion of the cam housing such that the rotator assembly is not able to transition between the modes of operation without an upward vertical load being applied by the operator.

In another aspect, the downward vertical mechanical force provided on the rotator prevents the rotator assembly from unintentionally moving in an upward vertical movement and then in a rotational movement that is required to transition the rotator between the sections of the cam rail corresponding with the different modes of operation.

In another aspect, transitioning between the different modes of operation (shorted mode and open mode) requires the rotary assembly being rotated along the cam rail a rotational distance of between about 30 degrees and about 150 degrees.

In another aspect, the cam rail contains three sections that correspond with the shorted mode of operation, an intermediate position, and an open mode of operation, each of these sections of the cam rail separated by a rotational distance of about 45 degrees.

In another aspect, the shorting plug has a cam housing having a bottom portion with a first electrode aperture and a second electrode aperture, at least one sidewall, and a top portion having an actuation aperture therein, wherein the bottom portion, the at least one side wall and the top portion define an interior space therein, a cam rail within the cam housing proximate the side wall, and the cam rail having at least a first section and a second section spaced apart on the cam rail by a distance. The shorting plug also has a rotator assembly having a rotator with a bottom section and a top section, a current bridging bar, a first electrode and a second electrode, wherein the bottom section has an aperture for containing the current bridging bar, the first and second electrodes electrically connected by the current bridging bar, and the first and second electrodes extending from the bottom section, and the bottom section operably engaging the cam rail and capable of at least partially rotating within the interior space between the at least first and second sections on the cam rail, wherein the top section at least partially extends through the actuation aperture and is capable of at least partially rotating with respect to the bottom portion. In this aspect, the first and second electrodes are capable of extending through the first and second electrode apertures of the cam housing, respectively, when the rotator is operably engaged with the first section of the cam rail, and the first and second electrodes are capable of being retracted within the cam housing when the rotator is operably engaged with the second section of the cam rail.

In another aspect, the shorting plug also has a cap housing comprising at least one sidewall and a top portion, the top section of the rotator connected to the top portion of the cap housing such that the cap housing is capable of at least partially rotating with respect to the rotator assembly.

In another aspect, the shorting plug has a first latch operably attached to the top portion of the cam housing at a first position, and the at least one sidewall of the cap housing having a window, wherein the first latch is capable of operably engaging the window when the rotator operably engages a section of the cam rail at a position corresponding to a shorted mode of operation.

In another aspect, the shorting plug has a second latch operably attached to the top portion of the cam housing at a second position, wherein the second latch is capable of operably engaging the window when the rotator operably engages the cam rail at a position corresponding to the open mode of operation.

In another aspect, the shorting plug has at least one visual indicator, the visual indicator capable of indicating whether the rotator is operably engaged with a first section of the cam rail with the first and second electrodes extending from the cam housing or whether the rotator is operably engaged in a second section of the cam rail with the first and second electrodes retracted within the cam housing.

In another aspect, the shorting plug contains visual indicators on the first latch and the second latch, wherein the visual indicators are differently colored latches corresponding to the shorted mode of operation and the open mode of operation, respectively.

In another aspect, the electrodes of the shorting plug have a floating design. In this aspect, a spring is located between the current bridging bar and rotator such that a downward vertical force is applied on the current bridging bar, which electrically connects the electrodes.

In another aspect, a method of operating a shorting plug on a pulsed power system from a shorted operational mode to an open operational mode is provided. The shorting plug contains cam housing having a rotator assembly with a current bridging bar electrically connected to a first and second electrode, the rotator assembly at least partially rotationally contained within the cam housing and capable of operably engaging a cam rail within the cam housing, the cam rail having at least a first section corresponding to the shorted operational mode and a second section corresponding to the open operational mode, the rotator assembly having a downward vertical force applied towards a bottom portion of the cam housing, the rotator assembly connected to a cap housing having a window, a first latch connected to the cam housing having a first horizontal force, a second latch connected to the cam housing having a second horizontal force, the first latch capable of operably engaging the window during the shorted operational mode, and the second latch capable of operably engaging the window during the open operational mode. In this aspect, the operator transitions the shorting plug between the two modes of operation (shorted mode and open mode) by depressing the respective latch into the cap housing in a direction opposite the first horizontal force, lifting the cap housing in an upward vertical direction opposite the downward vertical force being applied towards the bottom portion of the cam housing, rotating the cap housing such that the rotator assembly within the cam housing operably engages from the section corresponding with the current mode of operation to the desired mode of operation, and releasing the cap housing allowing the cap cover to move in a downward vertical direction by the downward vertical force being applied to the rotator assembly such that the respective latch is capable of operably engaging the window on the cap housing.

In another aspect, the shorting plug is configured such that the window of the cap housing is covered by the respective latch and the cam housing, which may include the cam cup, the top flange and/or the spacer whether an integral part or separate component from the top flange.

In another aspect, the shorting plug of the present invention is capable of short circuiting the internal storage capacitor of a high powered pulsed power system having energy in the 10 kV and 150,000 A range when in a shorted mode to make maintenance safe for the operator.

In another aspect, the shorting plug of the present invention is capable of providing an open circuit to the internal storage capacitor of a high pulsed power system when in an open mode, allowing up to 12 kV across one or more shorting plug openings.

In another aspect, the shorting plug of the present invention is capable of withstanding the tactical environment when employed in a mobile system, such as provided in a military operational, the tactical environment including hostile conditions such as shock, vibration, rain, dust, water immersion, humidity and the like. In some aspects, the shorting plug of the present invention is capable of operating effectively within this environment and capable of meeting the standards outlined in MIL-STD-810, incorporated by reference herein.

In another aspect, the shorting plug of the present invention is capable of being utilized in current high pulsed power systems, including high pulsed power systems available in military operations.

In another aspect, the shorting plug of the present invention is capable of interfacing to the contacts of an internal storage capacitor of a high pulsed power system, wherein the contacts of an internal storage capacitor can vary in position and flatness from capacitor to capacitor due to manufacturing tolerances.

In another aspect, the shorting plug of the present invention is operable with one hand by the operator.

In another aspect, the shorting plug of the present invention has visual indicators relating to the shorted mode and the open mode, allowing the operator to know the state of the shorting plug. In another aspect, the visual indicators are differently colored latches. In another aspect, the shorted mode is visually indicated by a green colored latch that operably engages the cap housing, whereas the open mode is visually indicated by a red colored latch that operably engages the cap housing.

In another aspect, the shorting plug of the present invention is capable of containing within the electrical energy storage device the entire discharged stored energy that may be retained on a fully charged electrical storage device when the shorting plug is transitioned from an open mode to a shorted mode, wherein the energy is dissipated throughout the entire energy storage device and the shorting plug maintains electrical insulation to the operator during the discharge event.

In another aspect, the shorting plug of the present invention is capable of maintaining electrical insulation to the operator with respect to an entire discharged stored energy that may be retained on a fully charged electrical storage device when the stored energy is not properly drained but instead is accidentally discharged through the shorting plug.

In another aspect, an operator of the shorting plug of the present invention is capable of transitioning the shorting plug from an open mode to a short mode by depressing with one or more fingers a first latch operably engaged in a locked position with the cap housing, lifting the cap housing, rotating the cap housing a rotational distance to the short mode position, and releasing the cap housing allowing the cap housing to operably engage a second latch, which locks the cap housing into a locked position in the short mode. In another aspect, the operator of the shorting plug of the present invention is capable of transitioning the shorting plug from the shorted mode to the open mode by depressing with one or more fingers the second latch operably engaged in the locked position with the cap housing, lifting the cap housing, rotating the cap housing an opposite rotational distance to the open mode position, and releasing the cap housing allowing the cap housing to operably engage the first latch, which locks the cap housing into a locked position in the open mode.

In another aspect, the shorting plug of the present invention is capable of providing at least one mechanical load in a vertical, horizontal or rotational orientation that needs to be overcome to transition the shorting plug between the open mode and the shorted mode.

In another aspect, the shorting plug of the present invention is capable of providing more than one mechanical load in a vertical, horizontal or rotational orientation that needs to be overcome to transition the shorting plug between the open mode and the shorted mode.

In another aspect, the shorting plug of the present invention is capable of providing a vertical mechanical force, a horizontal mechanical force, and a rotational mechanical force that needs to be overcome to transition the shorting plug between the open mode and the shorted mode.

In another aspect, the shorting plug of the present invention provides a rotator assembly connected to a cap housing having a window therein, the rotator assembly operably engaging a cam rail, a first latch that operably engages the window of the cap housing during the short mode of operation, and a second latch that operably engages the window of the cap housing during the open mode of operation, wherein a downward vertical mechanical force is provided on the rotator assembly that operably engages the cam rail that has at least one transition that limits rotational movement of the rotator assembly on the cam rail without an upward vertical force first being employed, such that the downward vertical mechanical force prevents the rotator assembly from unintentionally moving in an upward vertical movement and then in a rotational movement that is required to transition the shorting plug between the open mode of operation and the shorted mode of operation, wherein during the open mode of operation a horizontal mechanical force is provided on the first latch preventing the cap housing connected to the rotator assembly from unintentionally moving in an upward vertical manner and also from rotating without the first latch from being depressed into the cap housing by an opposite horizontal force, an upward vertical force, and a rotational force, the opposite horizontal force, the upward force, and the rotational force all being employed simultaneously to transition the cap housing from the open of operation to the shorted mode of operation, and wherein during the shorted mode of operation a horizontal mechanical force is provided on the second latch preventing the cap housing connected to the rotator assembly from unintentionally moving in an upward vertical manner and also from rotating without the second latch from being depressed into the cap housing by an opposite horizontal force, an upward vertical force, and a rotational force, the opposite horizontal force, the upward force, and the rotational force all being employed simultaneously to transition the cap housing from the shorted mode of operation to the open mode of operation.

These and other aspects of the present invention are described in the following claims or will become apparent to one of ordinary skill in the art from the detailed description of the invention in connection with the accompanying drawings.

While the present invention is amenable to various modifications and alternative forms, specifics thereof have been shown by way of example in the preceding drawings and will be further described in detail. In should be understood, however, that the intention is not to limit the present invention to the particular embodiments described. On the contrary, the intention is to cover all modifications, equivalents, and alternatives falling within the spirit and scope of the invention as defined in the appended claims.

DETAILED DESCRIPTION OF THE PRESENT INVENTION

While the present invention may be embodied in many different forms, there are described in detail herein specific preferred embodiments. This description is an exemplification of the principles of the present invention and is not intended to limit the invention to the particular embodiments illustrated.

The present invention is a shorting plug for safely providing an electrical short in an electrical circuit. A primary application of the shorting plug is in a pulsed power system having energy in the 10 kV and 150,000 A range. During operation, the shorting plug is capable of containing the entire discharged stored energy within the electrical storage device that may be retained on a fully charged electrical storage device when the shorting plug is engaged from an open or unshorted mode to a shorting mode. In the event the shorting plug is accidentally moved from the open or unshorted mode to the shorted mode with the capacitor at full charge, the shorting plug not only is capable of containing the entire discharged stored energy within the electrical storage device by dissipating the energy throughout the entire energy storage device, but the shorting plus also maintains electrical insulation to the operator during this accidental discharge. Thus, the shorting plug of the present invention is capable of electrically shorting a pulsed power system having an internal storage capacitor when in the shorted mode to make maintenance service safe for the operator. When provided in an open mode, the shorting plug is also capable of standoff of at least 12 kV. In some aspects, the shorting plug of the present invention is used in a pulsed power system in a fixed emplacement and a controlled environment such as a laboratory. In some aspects, the shorting plug of the present invention is used in a pulsed power system in a mobile system such as provided in a military operational environment that is subject to a hostile environment that includes shock, vibration, rain, dust, water immersion, humidity and the like.

Figures 1, 2:
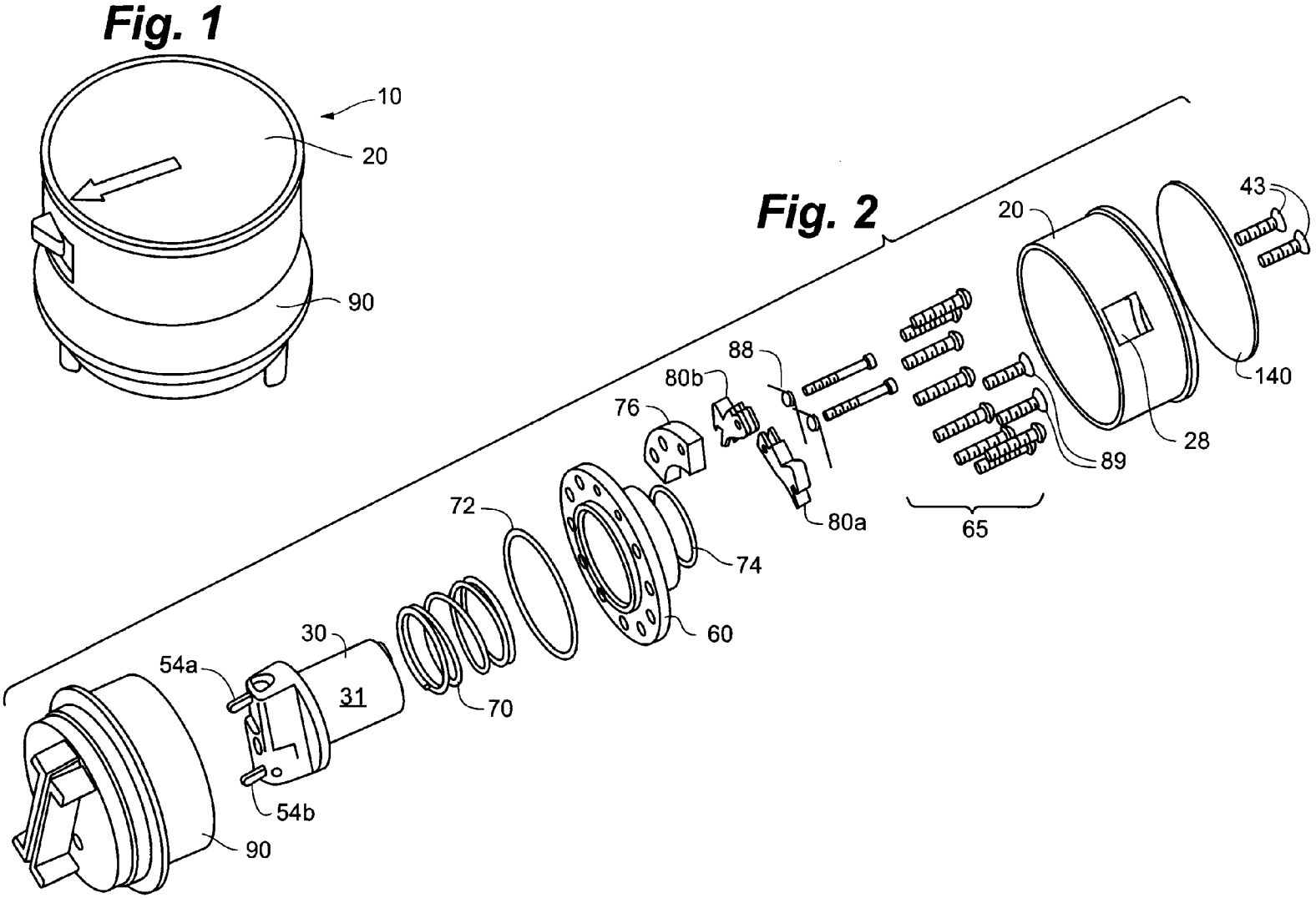
FIG. 1 shows a perspective view of a shorting plug assembly of an embodiment of the present invention.
FIG. 2 shows an exploded perspective view of the shorting plug assembly of FIG. 1.
Figure 8B:
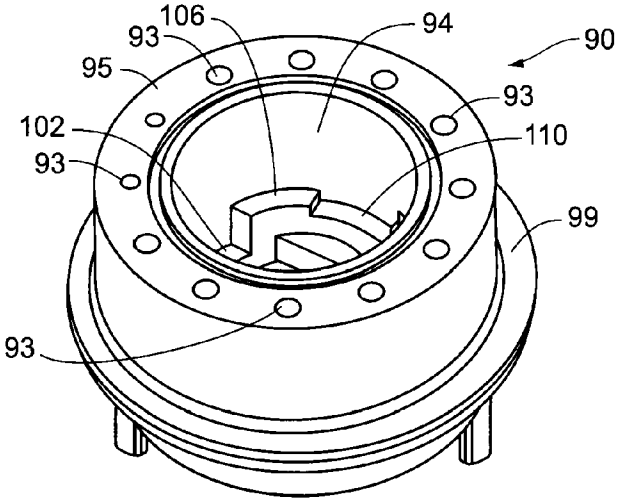
FIG. 8B shows a top-angle perspective view of the cam-cup component of the shorting plug assembly of FIG. 2.

Referring now to the figures, the shorting plug of the present invention is generally designated by the reference numeral 10. As illustrated in FIG. 1 and the exploded view in FIG. 2, in one aspect the shorting plug 10 contains a rotator assembly 30 having a rotator 31 with a bottom section 32 containing a pair of electrical contacts 54*a*, 54*b* extending from the rotator 31 and a cylindrical top neck section 34. The shorting plug 10 also contains a top flange 60 that is operably connected to a cam cup 90 by one or more fasteners 65 or the like to form a cam housing to at least partially contain the rotator assembly 30. A seal may also be provided at the interface between the top flange 60 and the cam cup 90 by an O-ring 72. In some aspects, the cam cup 90 may contain an inset 96 for setting the O-ring 72, as shown in FIG. 8B and cross-sectional representation shown in FIG. 8I.

Figures 9A, 9B, 9C:
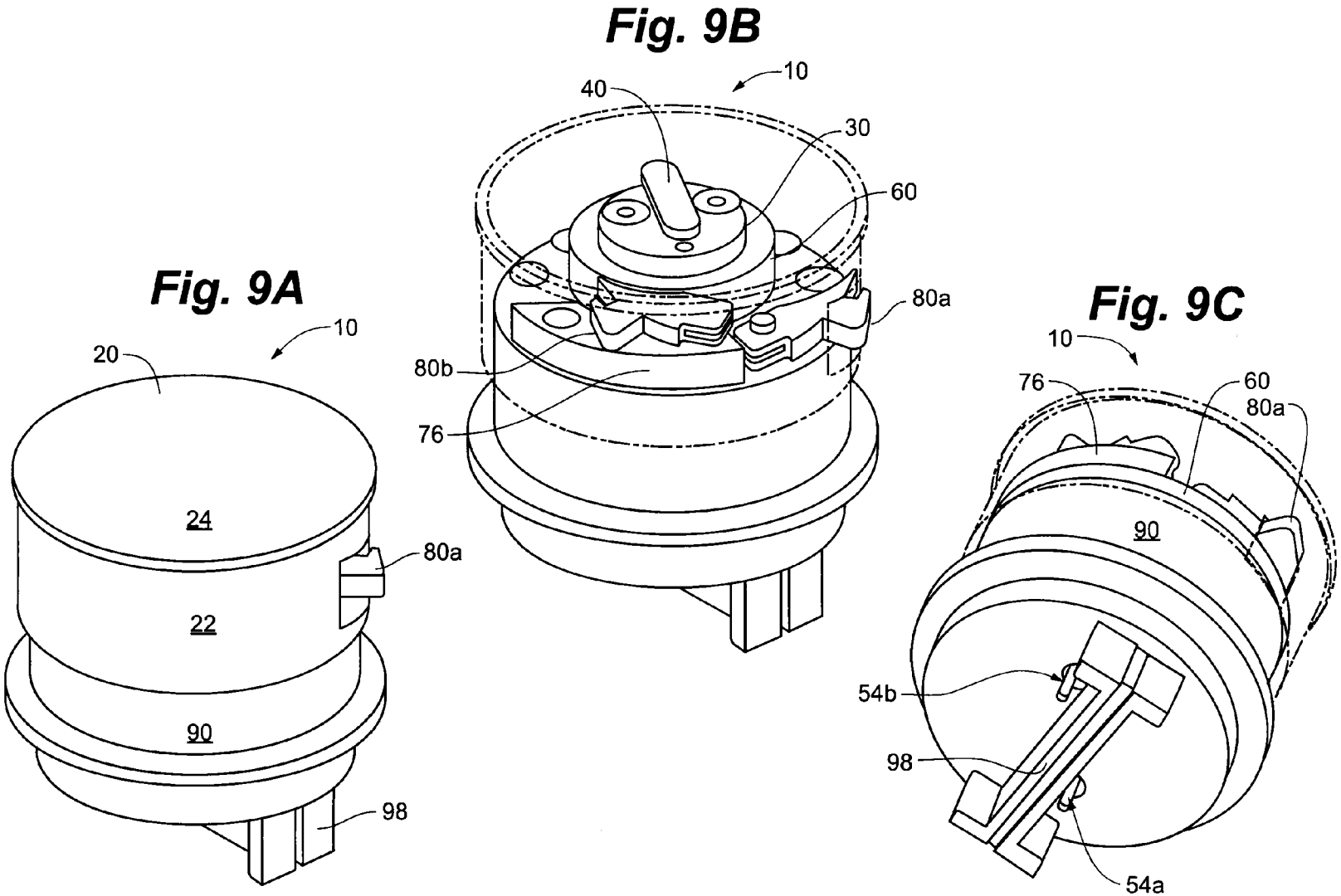
FIG. 9A shows a perspective view of a shorting plug assembly of an embodiment of the present invention.
FIG. 9B shows a perspective view of the shorting plug assembly of FIG. 9A with the top cup component shown in phantom view to illustrate the configuration of the shorting plug assembly in a shorting mode.
FIG. 9C shows a bottom-angle perspective view of the shorting plug assembly of FIG. 9B with the electrodes in an extended position relating to the shorting plug assembly in a shorting dmode.

The top neck section 34 of the rotator 31 extends into an aperture 62 of the top flange 60 and at least a portion extends through the top flange 60 such that the bottom section 32 of the rotator 31 is rotatably nested within an interior space 94 when the cam cup 90 is connected to the top flange 60 to form the cam housing. In some aspects, a segment of the top neck section 34 of the rotator assembly 30 extends through the top flange 60 such that the rotator assembly 30 operably engages and is capable of being connected to the top cup 20. In some aspects, the top cup 20 may contain an aperture 29, as shown in FIG. 3A, for receiving a protrusion 40 of the rotator assembly 30, as shown in FIGS. 9A and 9*b*. The top cup 20 may also be connected to the rotator assembly 30 by one or more fasteners 43 or the like. In an alternative aspect, the top cup 20 may contain a portion that extends into a portion of the top flange 60 to connect to the rotator assembly 30. In either aspect, the rotator assembly 30 and the connected top cup 20 are capable of independently rotating with respect to the cam housing comprising the cam cup 90 that is connected to the top flange 60, such that the bottom section 32 of the rotator 31 is rotatably nested within the interior space 94 when the cam cup 90 is connected to the top flange 60. The configuration of the protrusion 40 operably inserted into the aperture 29 on the top cup 20 may help provide support and leverage when rotating the rotator assembly 30 connected to the top cup 20. As discussed further herein, the configuration of the protrusion 40 and aperture 29 also may correspond with the electrical contacts 54*a*, 54*b* such that this configuration may also illustrate the relative rotational position of the rotator assembly 30 and the corresponding mode of the shorting plug—shorted mode or open mode. Accordingly, various geometric shapes (such as squares, rectangles, trapezoids and the like) and sizes of the protrusion 40 and corresponding aperture 29 are contemplated and incorporated herein.

Figure 6A:
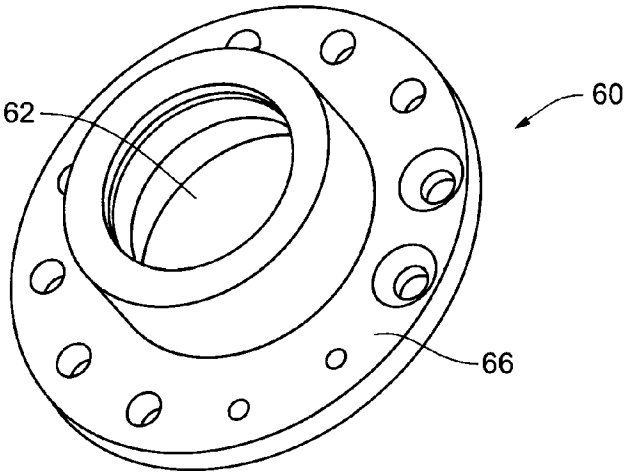
FIG. 6A shows a perspective view of the top-flange component of the shorting plug assembly of FIG. 2.
Figure 6C:
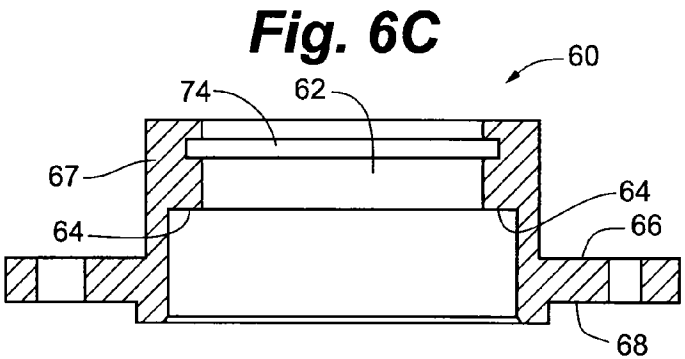
FIG. 6C shows a side cross-sectional representation of the top flange along the plane A-A' of FIG. 6B.
Figure 6B:
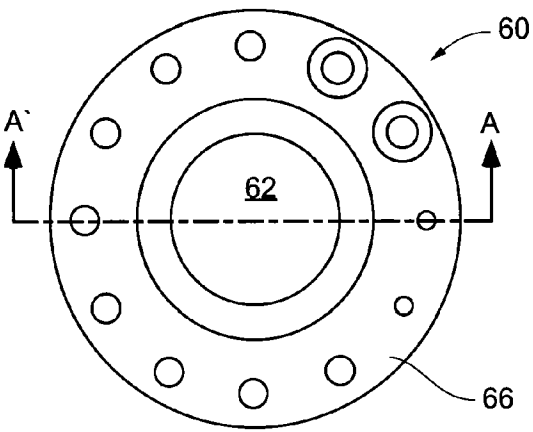
FIG. 6B shows a top view of the top flange component of the shorting plug assembly of FIG. 2.

As shown in FIGS. 2 and 6C, the top flange 60 may contain an O-ring 74 to provide a seal between the top flange 60 and corresponding portion of the top neck section 34 of the rotator assembly 30 that is operably engaged with the top flange 60. As shown in the cross-sectional representation of the top flange 60 in FIG. 6C, the top flange 60 may contain an inset 69 for setting the O-ring 74.

Figure 7B:
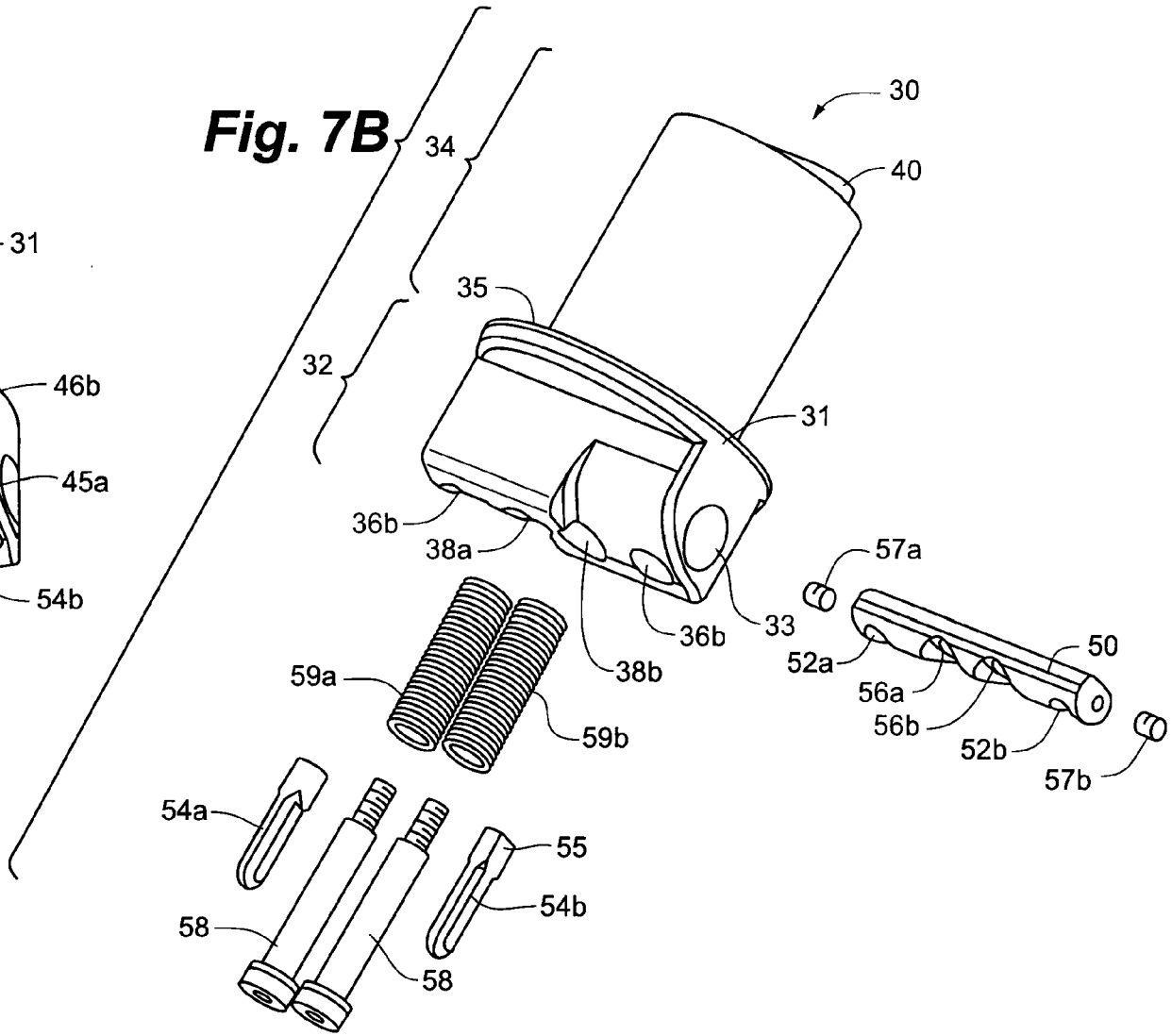
FIG. 7B shows an exploded perspective view of the rotator assembly of FIG. 7A.
Figure 7A:
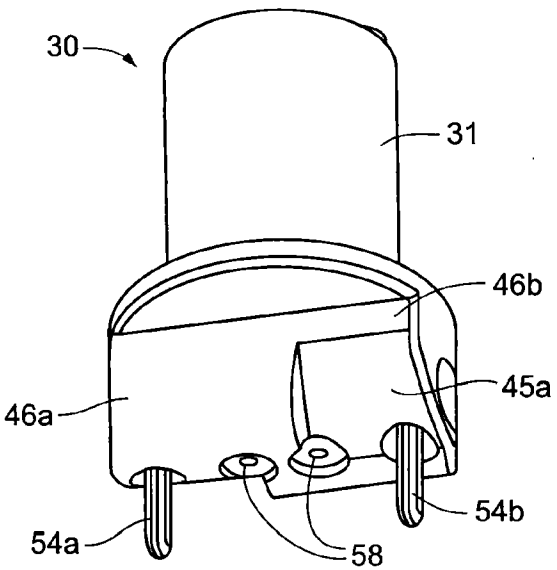
FIG. 7A shows a bottom-angle perspective view of the rotator assembly of the shorting plug assembly of FIG. 2.
Figure 7E:
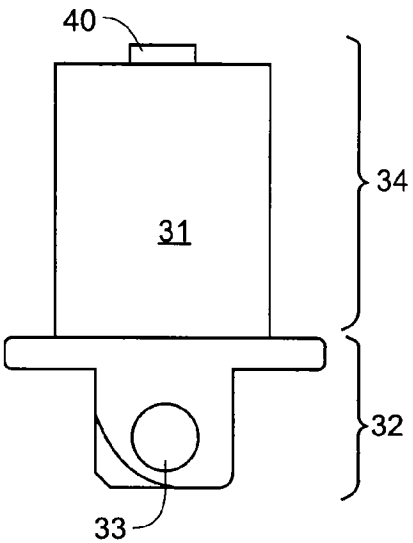
FIG. 7E shows a side view of the rotator component of the rotator assembly of FIGS. 7A-7B.
Figure 7D:
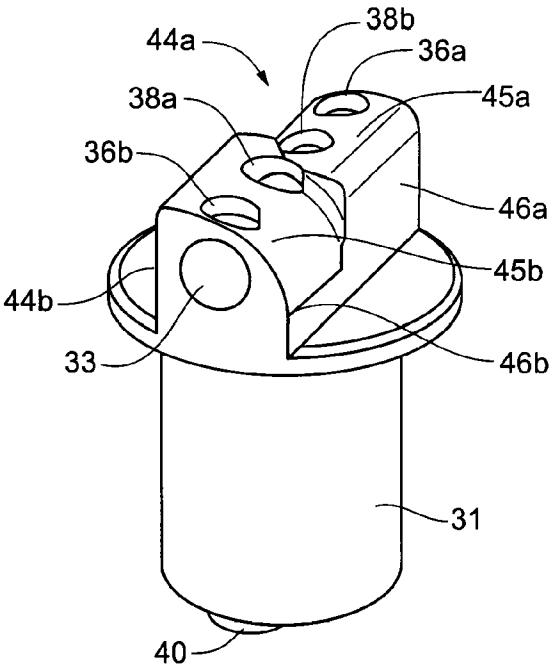
FIG. 7D shows another perspective view of the rotator component of the rotator assembly of FIGS. 7A-7B.
Figure 7C:
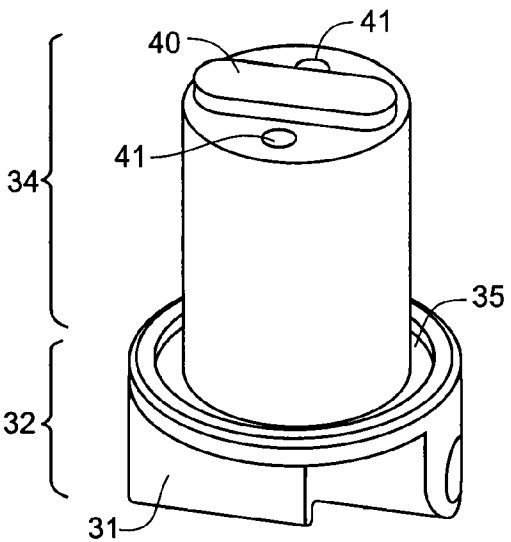
FIG. 7C shows a perspective view of the rotator component of the rotator assembly of FIGS. 7A-7B.

Referring now to FIG. 2, in some aspects, the top neck section 34 of the rotator 31 also fits within and at least a portion of the top neck section 34 extends through a spring 70 before extending through the aperture 62 of the top flange 60. In some aspects, the bottom section 32 of the rotator 31 is larger in diameter than the top neck section 34 such that the spring interfaces with n annular ridge 35 on the top side of the bottom section 32, as shown in FIG. 7C. In some aspects, the top flange 60 has an interior annular lip 64, as shown in FIG. 6C, that operably engages the spring 70, such that the spring 70 does not extend through aperture 62 of the top flange 60. In this aspect, when the cam cup 90 and top flange 60 are operably connected to form the cam housing for the rotator assembly 30, the spring 70 is contained between the annular ridge 35 of the rotator 31 and the interior annular lip 64 of the top flange 60, and the spring 70 is provided around the circumference of a segment of the top neck portion 34 of the rotator 31 that is located between the annular ridge 35 and the segment of the top neck portion 34 that is contained within the top flange 60 when the cam cup 90 and top flange 60 are operably connected to form the cam housing for at least partially containing the rotator assembly 30. In this configuration, the spring 70 provides a vertical force between the annular ridge 35 of the bottom section 34 of the rotator assembly 30 and the interior annular lip 64 of the top flange 60, which is connected to the cam cup 90, such that there is a downward vertical mechanical load forcing the rotator assembly 30 down into the bottom interior surface of the cam cup 90.

Figure 5:
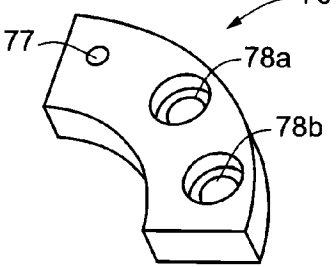
FIG. 5 shows a perspective view of the spacer component of the shorting plug assembly of FIG. 2.
Figure 9E:
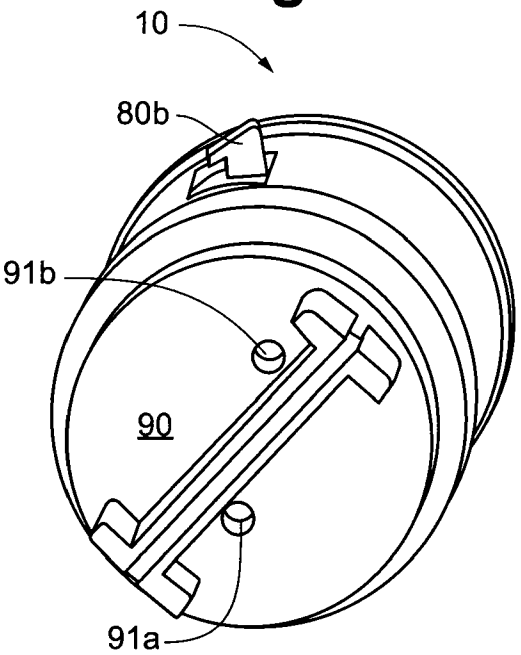
FIG. 9E shows a bottom-angle perspective view of the shorting plug assembly of FIG. 9D with the electrodes in a retracted and rotated-away position for higher standoff voltage protection relating to the shorting plug assembly in an open mode.
Figure 9D:
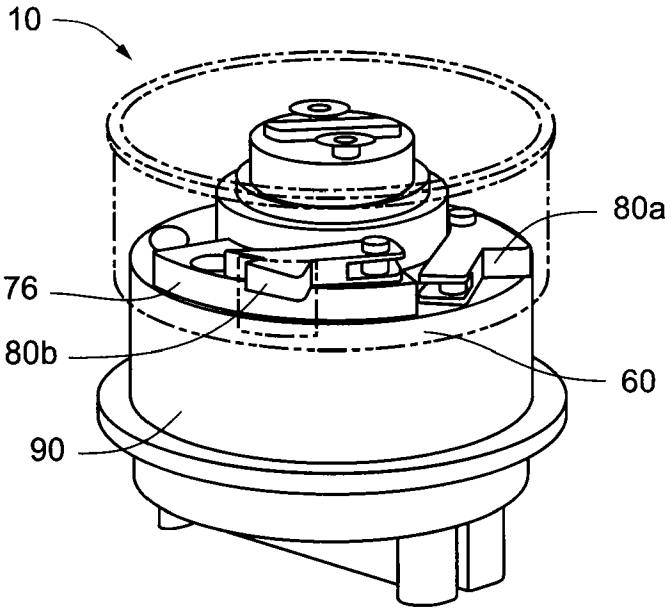
FIG. 9D shows a perspective view of the shorting plug assembly of FIG. 9A with the top cup component shown in phantom view to illustrate the configuration of the shorting plug assembly in an open mode.

The shorting plug 10 also contains two latches 80*a* and 80*b*. Latch 80*a* is operably connected to the top surface 66 of the top flange 60, and latch 80*b* is operably connected to the top surface 66 with a spacer 76 located between the latch 80*b* and the top surface 66 of top flange 60, as shown in FIGS. 9B and 9D. In some aspects, the spacer 76 is a separate component from the top flange 60 and is operably connected by one or more fasteners 89 and the like, by using one or more fastener receiving apertures 78*a*, 78*b* in the spacer 76, as shown in FIG. 5. In some alternative aspects, the spacer 76 is an integral part of the top flange 60 such that the entire top surface 66 of the top flange 60 is not all in the same plane. Whether provided as a separate component or an integral part of the top flange 60, the spacer 76 allows latches 80*a*, 80*b* to be provided in different horizontal planes when connected to the top flange 60. In some aspects, both latches 80*a*, 80*b* may contain a spacer located between the respective latch and the top flange 60, although it is preferable in this aspect that each respective spacer be of different thickness, such that the latches 80*a*, 80*b* are located in separate horizontal planes when connected to the top flange 60. As discussed further herein, the configuration of the latches 80*a*, 80*b* being provided in separate horizontal planes allows for a separate locking mechanism that corresponds with the respective mode of the shorting plug—shorted mode or open mode.

Figure 4B:
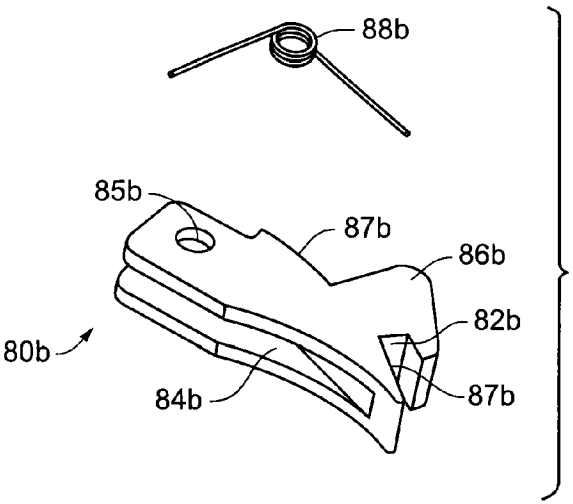
FIG. 4B shows a perspective view of the shorted-mode latch component of the shorting plug assembly of FIG. 2.
Figure 4A:
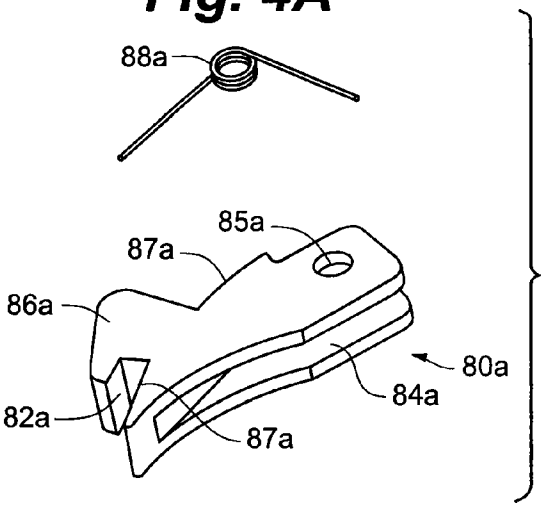
FIG. 4A shows a perspective view of the open-mode latch component of the shorting plug assembly of FIG. 2.

Referring now to FIGS. 4A and 4B, latches 80*a*, 80*b* each contain an aperture 85*a*, 85*b*, respectively, for receiving a fastener 83, which fastens the respective latch 80*a*, 80*b* to the top flange 60. A spacer 76 located between the respective latch 80*b* and the top flange 60 also contains an aperture 77 that allows for the fastening of the latch 80*b* with respect to the top flange 60, as shown in FIG. 5. In some aspects, the fastener 83 is fastened directly to the top flange 60, while in some other aspects, the top flange 60 contains an aperture such that the fastener 83 is threaded into the cam cup 90. In either configuration, the respective latches 80*a*, 80*b* are connected with respect to the top surface 66 of the top flange 60 that is connected to the cam cup 90 to form the cam housing for the rotator assembly 30.

Latches 80*a*, 80*b* also contain a slot 84*a*, 84*b* for receiving a respective arm of a torsion spring 88*a*, 88*b*, before being connected with respect to the top flange 60. In some aspects, the torsion spring 88*a*, 88*b* is held within the respective latch 80*a*, 80*b* by the fastener 83 that also secures the respective latch 80*a*, 80*b* to the top surface 66 of the top flange 60. When connected to the top surface 66, the other arm of the respective spring 88*a*, 88*b* is configured to operably engage the neck 67 of the top flange 60. This respective spring 88*a*, 88*b* and latch 80*a* 80*b* configuration provides a horizontal mechanical force pushing the respective latch 80*a*, 80*b* out and away from the neck 67 of the top flange 60. In some aspects, it is also contemplated that one or more of the springs 88*a*, 88*b* may be configured to operably engage a portion of the top neck section 34 of the rotator assembly 30. It is also contemplated that one spring 88*a* or 88*b* may be configured to operably engage the top flange 60 while the other spring 88*a* or 88*b* operably engages a portion of the top neck section 34 of the rotator assembly 30.

Figure 3B:
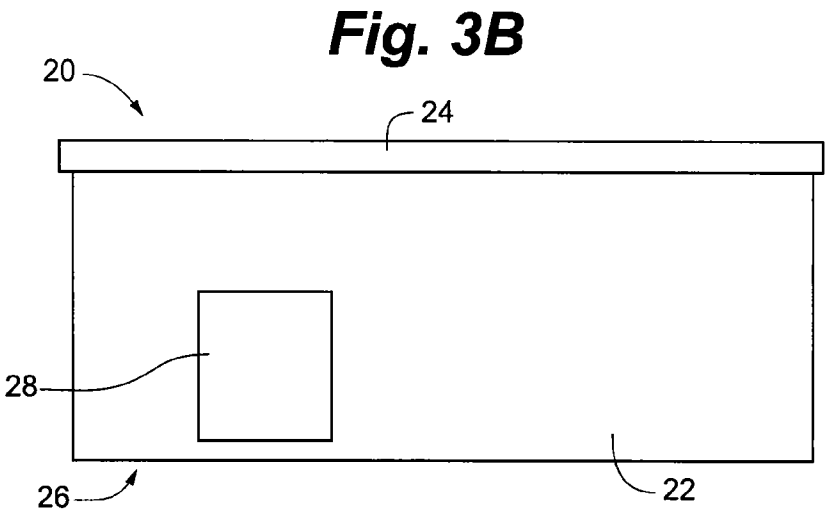
FIG. 3B shows a side view of the top-cup component of the shorting plug assembly of FIG. 2.
Figure 3A:
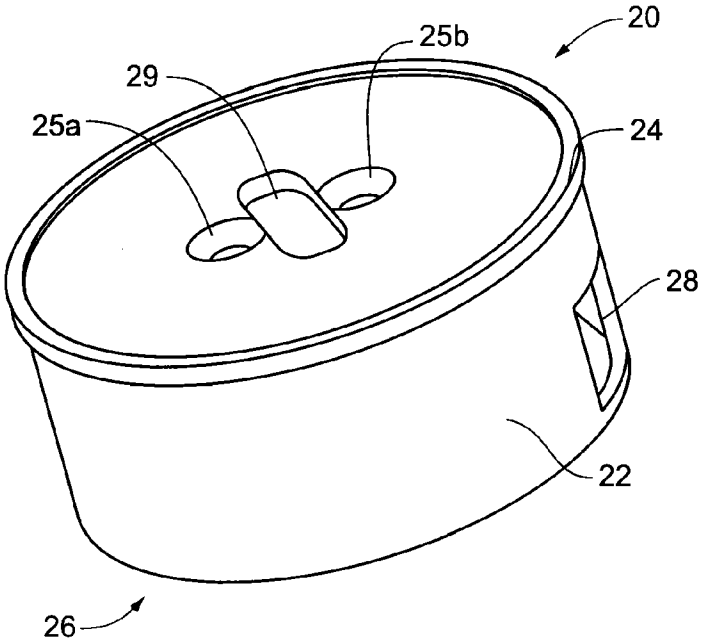
FIG. 3A shows a top-angle perspective view of the top-cup component of the shorting plug assembly of FIG. 2.

Referring now to FIGS. 2, 3A and 3B, top cup 20 contains a cylindrical side wall 22 that is perpendicular to both a top surface 24 and an open bottom area 26. The top cup 20 also contains a window 28 located within the cylindrical side wall 22. When the top cup 20 is connected to the rotator assembly 30, a portion of the side wall 22 operably engages the cam cup 90, such that the top cup 22 houses at least the top flange 60, the top neck section 34 of the rotator 31 that extends out of the top flange 60, the spacer 76 (whether a separate or integral part of the top flange 60), and the respective spring 88*a*, 88*b* and latch 80*a* 80*b* configurations, as shown in FIGS. 9A-9D.

Referring now to FIGS. 9B and 9D, the window 28 in the side wall 22 of the top cup 20 (the top cup 20 being shown in a phantom view to illustrate the internal configurations of the shorting plug) is preferably sized and configured such that the protruding portion 86*a*, 86*b* of the respective latch 80*a*, 80*b* operably engages the window 28. The latches 80*a*, 80*b* are preferably spaced apart around the radius of the top flange 60 such that only one of the latches 80*a*, 80*b* is able to operably engage with the window 28 at a time. As discussed further herein, the latches 80*a*, 80*b* are spaced apart to correspond with the different sections of the cam rail 100 operably engaging the rotator assembly 30, the different sections of the cam rail 100 corresponding with the respective mode of the shorting plug—shorted mode or open mode. In some aspects, the latches 80*a*, 80*b* are spaced apart such that the respective protruding portions 86*a*, 86*b* of latches 80*a*, 80*b* are about 90° apart when they operably engage window 28. In this configuration, rotating between protruding portion 86*a* of latch 80*a* and protruding portion 86*b* of latch 80*b* is accomplished by about a 90° rotational turn of the top cup 20 (and connected rotator assembly 30). In this aspect, toggling between the shorted mode and the open mode can be accomplished by about a ¼ turn of the top cup 20 that is rotationally connected to the rotator assembly 30 containing electrical contacts 54*a*, 54*b*. Accordingly, the electrical contacts 54*a*, 54*b* are either in the shorted mode and respectively protrude through apertures 91*a*, 91*b* of the cam cup 90, or are in the open mode by being rotated optimally about 90° away from the apertures 91*a*, 91*b*.

In some other aspects, it is contemplated that the latches 80*a*, 80*b* are spaced such that rotating between protruding portion 86*a* of latch 80*a* and protruding portion 86*b* of latch 80*b* (and thus the different sections of the cam rail 100 that allows electrical contacts 54*a*, 54*b* being toggled between the shorted mode and the open mode) can be accomplished with a rotational turn between about 25° and about 155° of the top cup 20 (and connected rotator assembly 30), in some other aspects between about 45° and about 145°, and still some other aspects between about 60° and about 120°, although other subranges within these ranges are contemplated and incorporated herein.

Referring now to FIG. 9D, when the latch 80*a* and the window 28 operably engage as shown, the area of the window 28 is covered by the latch 80*a*, the spacer 76 and the top flange 60. It is also contemplated that the window 28 may be covered by the latch 80*a* and one or more of the spacer 76 (whether a separate component or integral with the top flange 60), the top flange 60 and/or the cam cup 90.

Referring now to FIG. 9B, when the latch 80*b* and the window 28 operably engage as shown, the area of the window 28 is covered by the latch 80*b*, the top flange 60 and the cam cup 90. It is also contemplated that the window may be covered by the latch 80*a* and one or more of the spacer 76 (whether a separate component or integral with the top flange 60), the top flange 60 and/or the cam cup 90.

As shown in FIGS. 9B and 9D, the top cup 20 is configured to operably engage with a relatively tight tolerance around the circumference of at least a portion of the cam cup 90, top flange 60, spacer 76 and/or latches 80*a*, 80*b*, such that the exposure of the interior area of the shorting plug 10 under the top cup 20 to environmental components such as water, dirt, dust, sand and the like, is minimized.

As shown in FIGS. 4A, 4B, 9B and 9D, the latches 80*a*, 80*b* are also configured such that the radial surfaces 87*a*, 87*b* of the respective latch 80*a*, 80*b* are optimally curved or arced to correspond with the internal radial surface of the cylindrical side wall of the top cup 20. The latches 80*a*, 80*b* are also configured such that the radial surfaces 87*a*, 87*b* are dimensionally larger than the width of the widow 28. The latches 80*a*, 80*b* are also configured to have a protruding portion 86*a*, 86*b* with a respective slot portion 82*a*, 82*b* to generally provide an L-shape or J-shape, which provides a rotational locking mechanism that prevents the top cup 20 from being rotated in either axial direction without the respective latch 80*a*, 80*b* first being pushed by the operator into the interior area of the shorting plug 10 under the top cup 20. The rotation locking mechanism provided by the respective latch 80*a*, 80*b* also allows the window 28 to be covered by the radial surfaces 87*a*, 87*b* of the respective latch 80*a*, 80*b* without the window 28 being rotated past the length of the respective radial surface 87*a*, 87*b*.

Referring now to FIGS. 7A-7E, the rotator assembly 30 contains a rotator 31 with a bottom section 32 and a top neck section 34 that is preferably cylindrically shaped. In some aspects, the bottom section 32 of the rotator 31 contains an annular ridge 35 that is larger in diameter than the top neck section 34. As previously discussed, the annular ridge 35 operably engages a spring 76 located on the top neck section 34 of the rotator 31. In some aspects, it is contemplated that the bottom section 32 may have one or more portions that are smaller in diameter and/or the same diameter as the top neck section 34. It is also contemplated that the top neck section 34 may have one or more sized diameters, such as the portion of the top neck section 34 that interfaces within the top flange 60 and protrudes therefrom being smaller in diameter than the other portion of the top neck section 34 located between the annular ridge 35 and the portion that actually contacts the interior of the top flange 60.

As shown in FIGS. 7A-7E, the bottom section 32 located below the interface of the top neck section 34 and annular ridge 35 contains a first arcuate surface 45*a* extending between a first vertical section 44*a* and a second vertical section 46*a*, the second vertical section 46*a* having a greater vertical length projecting away from the surface defined by the horizontal plane containing the annular ridge 35 than the first vertical section 44*a*. This portion of the bottom section 32 also contains a second arcuate surface 45*b* extending between a first vertical section 46*b* and a second vertical section 44*b*, the second vertical section 44*b* having a greater vertical length projecting away from the surface defined by the plane containing the annular ridge 35 than the first vertical section 46*b*. Also, the first vertical sections 44*a*, 44*b* are contained within the same vertical plane, and the second vertical sections 46*a*, 46*b* are contained within the same vertical plane, with vertical sections 44*b* and 46*a* having a greater vertical length projecting away from the surface defined by the horizontal plane containing the annular ridge 35 than respective vertical sections 44*a* and 46*b*, such that the first and second arcuate surfaces 45*a*, 45*b* extend in opposite arcuate directions.

The rotator 31 contains a bridging bar aperture 33 extending through the diameter of the corresponding bottom section 32. The bridging bar aperture 33 is capable of receiving a current bridging bar 50 that is comprised of a conductive material, which may comprise a metal such as copper, a copper alloy, or the like. The bottom section 32 also contains at least two contact apertures 36*a*, 36*b* located on the respective arcuate surface 45*a*, 45*b* that extend into the rotator 31 in a substantially perpendicular manner with respect to the bridging bar aperture 33. The contact apertures 36*a*, 36*b* operably receive respective electrical contacts 54*a*, 54*b* comprised of a conductive material, which may comprise a metal such as copper, a copper alloy, or the like. The electrical contacts 54*a*, 54*b* inserted into the respective contact apertures 36*a*, 36*b* operably electrically connect to the current bridging bar 50 to provide an electrical connection between the two electrical contacts 54*a*, 54*b* through the current bridging bar 50. In some aspects, the electrical contacts 54*a*, 54*b* have a threaded end that inserts into the respective contact apertures 36*a*, 36*b* and threads into the respective aperture 52*a*, 52*b* of the current bridging bar 50 within the bridging bar aperture 33 to provide an electrical connection between the two electrical contacts 54*a*, 54*b*. In some aspects, the electrical contacts 54*a*, 54*b* have a flat face 55*a*, 55*b* that inserts into the respective contact apertures 36*a*, 36*b* and is secured to the current bridging bar 50 within the bridging bar aperture 33 by a fastener 57*a*, 57*b*, such as a set screw, that screws into the respective end of the current bridging bar 50 and operably engages the respective flat face 55*a*, 55*b* of the respective electrical contact 54*a*, 54*b* to provide an electrical connection between the two electrical contacts 54*a*, 54*b* through the current bridging bar 50.

The bottom section 32 also contains two spring apertures 38*a*, 38*b* located on the respective arcuate surface 45*a*, 45*b* that extend into the rotator 31 perpendicularly to the bridging bar aperture 33. Each respective spring aperture 38*a*, 38*b* is capable of receiving a spring 59*a*, 59*b*. The respective spring 59*a*, 59*b* is inserted within the respective spring aperture 38*a*, 38*b* prior to the insertion of the current bridging bar 50, such that the springs 59*a*, 59*b* provide a downward vertical force onto the installed current bridging bar 50 and electrical contacts 54*a*, 54*b* connected to the current bridging bar 50. This configuration allows the electrical contacts 54*a*, 54*b* and current bridging bar 50 to float with respect to the rotator 31.

In some aspects, fastening means, such as one or more fasteners 58, may also be employed to regulate and adjust the amount that the current bridging bar 50 vertically floats within the bridging bar aperture 33, and thus the electrical contacts 54*a*, 54*b* connected to the current bridging bar 50. As shown in FIG. 7B, a fastener 58*a*, 58*b* may be inserted into the respective spring aperture 38*a*, 38*b*, such that an axial end 58*a*', 58*b*' of the respective fastener 58*a*, 58*b* extends through the respective fastener aperture 56*a*, 56*b* of the current bridging bar 50, through the interior of the respective spring 59*a*, 59*b*, and threads into the body of the bottom section 32 at an axial end (not shown) of the respective spring aperture 38*a*, 38*b*. The distal end 58*a*", 58*b*" of the respective fastener 58*a*, 58*b* is larger than the respective fastener aperture 56*a*, 56*b* of the current bridging bar 50, such that the distal end 58*a*", 58*b*" operably engages the current bridging bar 50 and limits the vertical movement of the current bridging bar 50 and connected electrical contacts 54*a*, 54*b*.

In some aspects, it is preferred that the current bridging bar 50 and electrical contacts 54*a*, 54*b* are capable of floating about 1/16 to about 1 inch with respect to the respective arcuate surface 45*a*, 45*b*, in some other aspects about 1/16 of an inch to about 1/2 of an inch, and in some further aspects about 1/8 of an inch to about 1/4 of an inch, with other ranges and subranges within these ranges incorporated herein. As used herein, the term float or floating is meant to mean a range of variation or tolerance that the electrical contacts 54*a*, 54*b* may move in the vertical direction, such that the electrical contacts 54*a*, 54*b* are not required to be machined to a tight and costly tolerance to properly engage with the capacitor top contacts (not shown) during a short-mode to provide a proper and safe electrical connection between the shorting plug 10 and the capacitor.

In some aspects, the electrical contacts 54*a*, 54*b* are connected to the current bridging bar 50 such that the electrical contacts 54*a*, 54*b* extend from the respective arcuate surface 45*a*, 45*b* a desired distance such that the respective electrical contact 54*a*, 54*b* is capable of extending through aperture 91*a*, 91*b* of the cam cup 90 when the shorting plug is in the short mode. In some aspects the electrical contacts 54*a*, 54*b* extend from the respective arcuate surface 45*a*, 45*b* between about ¼ of an inch to about 2 inches, in some other aspects about ½ of an inch to about 1 inch, and still on some further aspects about 9/16 of an inch to about ¾ of an inch, with other ranges and subranges within the foregoing ranges incorporated herein.

Referring now to FIGS. 8A-8H, the cam cup 90 comprises a cylindrical side wall 92 having a circular top surface 95 that interfaces with the top flange 60, an interior bottom surface 97, an interior space 94 defined within the cylindrical side wall 92 and interior bottom surface 97, and a cam rail 100. The cam cup 90 also has a plurality of apertures 93 located on the circular top surface 95 for securing the top flange 60 to the top surface 95, the spacer 76 (when a separate component) to the top flange 60, and/or the latches 80*a*, 80*b* to the top flange 60. The cam cup 90 may also have an inset 96 for seating an O-ring 72 therein to provide a seal between the top surface 95 and the top flange 60 when connected.

Figure 8A:
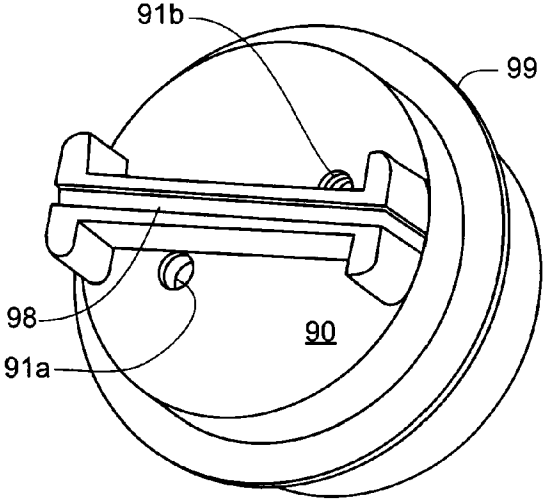
FIG. 8A shows a bottom-angle perspective view of the cam-cup component of the shorting plug assembly of FIG. 2.
Figure 8I:
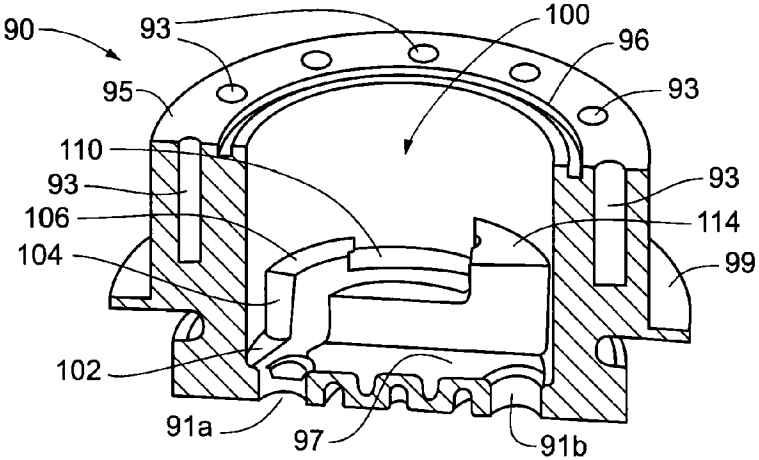
FIG. 8I shows a side cross-sectional representation of the cam-cup component along the plane A-A' of FIG. 8.

As shown in FIG. 8A, the cam cup 90 has a plug 98 located on the exterior bottom side that is structured to couple with the a header assembly 150 of an electrical energy storage device, such as a capacitor, which is described in co-pending application Ser. No. 13/095,285 and is incorporated by reference in its entirety herein. Also located on the exterior bottom side, the cam cup 90 contains apertures 91*a*, 91*b* that allow the electrical contacts 54*a*, 54*b* to extend out of the interior area of the cam cup 90 and make electrical connection to the respective electrical contacts 156*a*, 156*b* on the header assembly 150 during the short mode. Conversely, apertures 91*a*, 91*b* allow the electrical contacts 54*a*, 54*b* to be retracted back into the interior area of the cam cup 90 to prevent electrical connection to the respective electrical contacts 156*a*, 156*b* on the header assembly 150 during the open mode.

The cam rail 100 located in the interior of the cam cup 90 operably interacts with the rotator assembly 30 such that the shorting plug 10 is capable of being toggled between the short mode with the electrical contacts 54*a*, 54*b* extending through apertures 91*a*, 91*b* and the open mode with the electrical contacts 54*a*, 54*b* retracted into the interior of the cam cup 90. The cam rail 100 has different sections that operably interact with the rotator assembly 30 during the rotation of the top cup 20 during operational use.

Figures 8C, 8D, 8E, 8F, 8G, 8H:
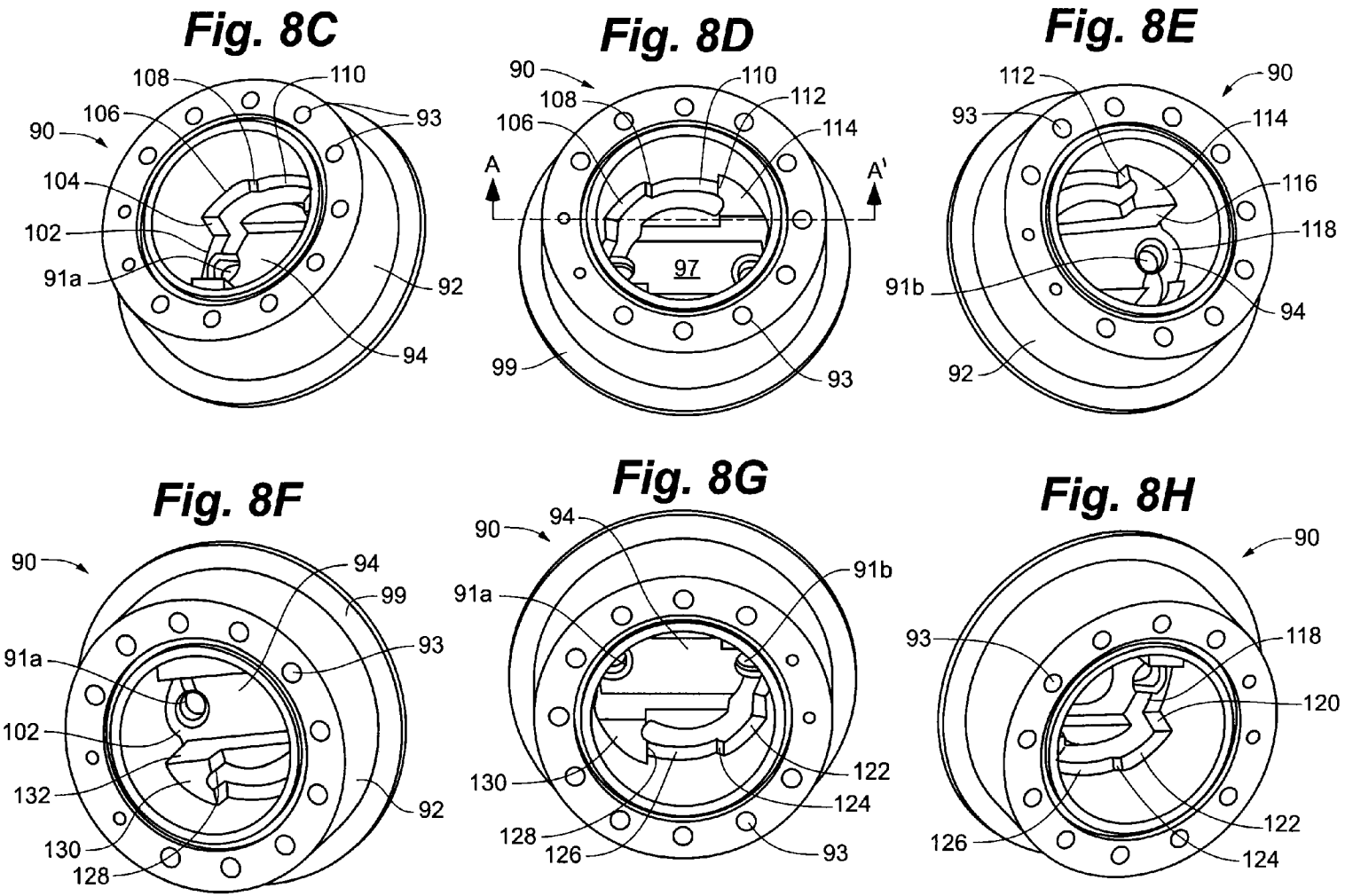
FIGS. 8C-8H show various top-angle perspective views of the cam-cup component of the shorting plug assembly of FIGS. 2 and 8B.

Referring now to FIGS. 8C-8H is shown a 360° view of the cam rail 100 substantially located along the interior perimeter of the cylindrical side wall 92. As shown in FIG. 8D and the corresponding cross-sectional view in FIG. 8I, plane A-A' is perpendicular to the top surface 95 and passes through the center of apertures 91*a*, 91*b* on the bottom surface of the cam cup 90. Plane A-A' in this configuration is also applicable to the views in FIGS. 8C and 8E-8H, although not shown.

Figure 10:
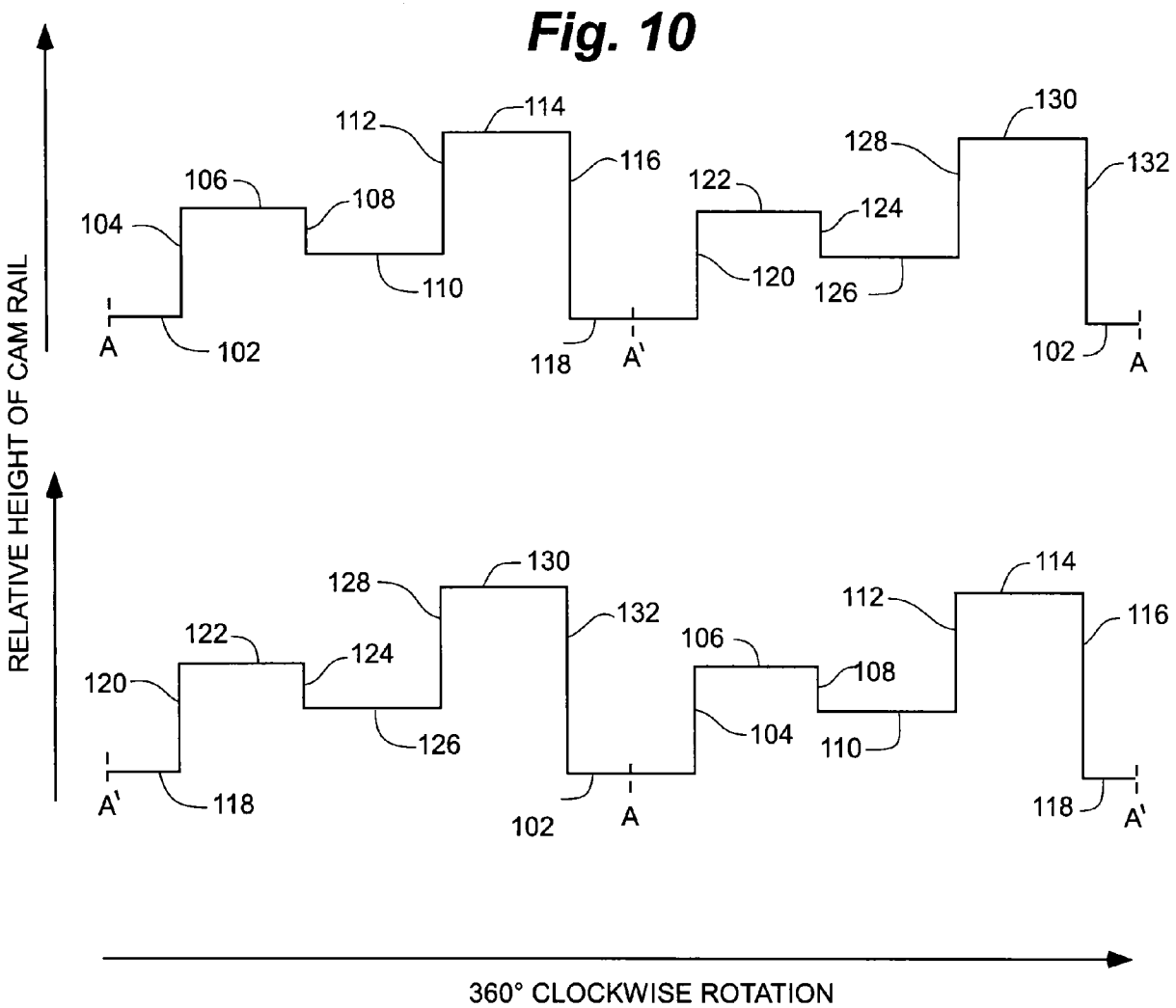
FIG. 10 is a graphical representation of the sections of the cam rail having different relative heights in a 360 degree clockwise rotation as illustrated in FIGS. 8A-8I, the starting points for the 360 degree clockwise rotational representation along the cam rail being: (i) the intersection of the plane A-A' (as shown in FIG. 8D) and the cam rail on the A-side of the plane (top diagram of FIG. 10), and (ii) the intersection of the plane A-A' (as shown in FIG. 8D) and the cam rail on the A'-side of the plane A-A' (bottom diagram of FIG. 10).

Starting at the point that plane A-A' intersects the cam rail 100 on the A-side of the plane proximate aperture 91*a* and continuing in a 360° rotational clockwise direction along the cam rail 100, the cam rail 100 has a first short section 102, a first transition 104, a first intermediate section 106, a second transition 108, a first open section 110, a third transition 112, a first stopper section 114, a fourth transition 116, a second short section 118, a fifth transition 120, a second intermediate section 122, a sixth transition 124, a second open section 126, a seventh transition 128, a second stopper section 130, and an eighth transition 132. As shown in FIGS. 8A-8I and graphically represented in the top graphical portion of FIG. 10, the first short section 102, the first intermediate section 106, the first open section 110, and the first stopper section 114 all have different relative heights with respect to each other away from the interior bottom surface 97. The second short section 118, the second intermediate section 122, the second open section 126, and the second stopper section 130 also all have different relative heights with respect to each other away from the interior bottom surface 97. These different relative heights of the sections are accomplished by the different relative heights of the transitions 104, 108, 112, 116 with respect to each other, and the transitions 120, 124, 128, 132 with respect to each other. The bottom graphical portion of FIG. 10 also illustrates these respective sections and transitions of the cam rail 100 starting at the point that plane A-A' intersects the cam rail 100 on the A'-side of the plane proximate aperture 91*b* and continuing in a 360° rotational clockwise direction along the cam rail 100.

In some aspects, the first short section 102 and the second short section 118 have about the same relative height away from the interior bottom surface 97, the first intermediate section 106 and the second intermediate section 122 have about the same relative height away from the interior bottom surface 97, the first open section 110 and the second open section 126 have about the same relative height away from the interior bottom surface 97, and the first stopper section 114 and the second stopper section 130 have about the same relative height away from the interior bottom surface 97. In relative terms, the short sections 102, 118 are the closest to the interior bottom surface 97, followed by the open sections 110, 126, followed by the intermediate sections 106, 122, with the stopper sections 114, 130 having a vertical distance the farthest from the interior bottom surface 97. In some aspects, the short sections 102, 118 have no vertical distance away from the bottom surface 97.

The cam rail 100 operably interacts with the rotator assembly 30 during the rotation of the top cup 20 during operational use. With respect to the short mode, the first arcuate surface 45*a* operably interacts with the first short sect ion 102 and the second arcuate surface 45*b* operably interacts with the second short section 118. Along with the downward vertical force provided by the spring 70 onto the rotator assembly 30, first vertical section 44*a* and a second vertical section 46*a* on rotator 31 also operably interact with first transition 104 and eighth transition 132 of cam rail 100, respectively, and first vertical section 46*b* and second vertical section 44*b* on rotator 31 also operably interact with fifth transition 120 and fourth transition 116 of cam rail 100, respectively, to prevent rotator assembly 30 from rotating clockwise or counterclockwise. In this configuration, electrical contacts 54*a*, 54*b*, which protrude from respective arcuate surfaces 45*a*, 45*b*, respectively, are pushed in a downward vertical manner to extend through respective apertures 91*a*, 91*b* and protrude through the bottom exterior surface of the cam cup 90 during a short mode, as illustrated in FIG. 9C. As illustrated in FIGS. 9B and 9C, during the short mode latch 80*a* also operably interacts with window 28 on the top cup 20 such that protruding portion 86*a* extends through window 28 and slot portion 82*a* operably engages the cylindrical side wall 22 proximate the window 28. In some aspects, the latch 80*a* has a visual indicator, such as a color, shape, or the like, that provides the operator with an indication that the shorting plug 10 is in the short mode.

With respect to the open mode, the first arcuate surface 45*a* operably interacts with the first open section 110 and the second arcuate surface 45*b* operably interacts with the second open section 126. Along with the downward vertical force provided by the spring 70 onto the rotator assembly 30, first vertical section 44*a* and a second vertical section 46*a* on rotator 31 also operably interact with third transition 112 and second transition 108 of cam rail 100, respectively, and first vertical section 46*b* and second vertical section 44*b* on rotator 31 also operably interact with seventh transition 128 and sixth transition 124 of cam rail 100, respectively, to prevent rotator assembly 30 from rotating clockwise or counterclockwise. In this configuration, electrical contacts 54*a*, 54*b* are contained within the interior space 94 proximate the open sections 110, 126 in a rotated and elevated position with respect to apertures 91*a*, 91*b*. In some aspects, the electrical contacts 54*a*, 54*b* are rotated about 45° with respect to the apertures 91*a*, 91*b* (and thus plane A-A') when the rotator assembly 30 is rotated such that the first arcuate surface 45*a* operably interacts with the first open section 110 and the second arcuate surface 45*b* operably interacts with the second open section 126. As illustrated in FIGS. 9D and 9E, during the open mode latch 80*b* also operably interacts with window 28 on the top cup 20 such that protruding portion 86*b* extends through window 28 and slot portion 82*b* operably engages the cylindrical side wall 22 proximate the window 28. In some aspects, the latch 80*b* has a visual indicator, such as a color, shape, or the like, that provides the operator with an indication that the shorting plug 10 is in the open mode.

When toggling between the short mode and the open mode, or the open mode and the short mode, the respective latch 80*a*, 80*b* that operably engages the top cup 20 proximate window 28 is depressed into the interior of the short plug 10 by the operator, the operator lifts the top cover 20, and rotates the top cover 20 to the other respective position. In some aspects, depressing the respective latch 80*a*, 80*b* and lifting and rotating the top cover 20 can be conducted by the operator using one hand. By lifting the top cover 20, the operator also lifts the connected rotator assembly 30 within the cam cup 90, such that the respective arcuate surface 45*a*, 45*b* is capable of being operably rotated past the respective intermediate section 106, 122 and to the other desired mode.

For instance, when toggling from the shorted mode to the open mode, lifting the top cover 20 (and the connected rotator assembly 30) allows the first vertical section 44*a* to move in a clockwise direction past the first transition 104 and the first vertical section 46*b* to move in a clockwise direction past the fifth transition 120, such that the first and second arcuate surfaces 45*a*, 45*b* operably engage the intermediate sections 106, 122, respectively, until the rotator assembly 30 is rotated until the first and second arcuate surfaces 45*a*, 45*b* operably engage with the open sections 110, 126, respectively, which will also result in the latch 80*a* operably engaging the window 28 on the top cup 20 (FIGS. 9D and 9E).

Similarly, when toggling from the open mode to the shorted mode, lifting the top cover 20 (and the connected rotator assembly 30) allows the second vertical section 46*a* to move in a counter-clockwise direction past the second transition 108 and the second vertical section 44*b* to move in a counter-clockwise direction past the sixth transition 124, such that the first and second arcuate surfaces 45*a*, 45*b* can operably engage the intermediate sections 106, 122, respectively, until operably engaged with the short sections 102, 118, respectively, which will result in the latch 80*b* operably engaging the window 28 on the top cup 20 (FIGS. 9B and 9C).

When toggling between the short mode and the open mode, such that the respective arcuate surface 45*a*, 45*b* is operably engaged with the respective intermediate section 106, 122, neither latch 80*a*, 80*b* operably engages the window 28 on the top cup 20.

While the foregoing discussion regarding the interaction between the rotator assembly 30, cam rail 100 and latches 80*a*, 80*b* with respect to window 28 has been based upon the rotator assembly 30 being rotated in a clockwise direction when toggling from the short mode to the open mode, the various sections of the cam rail 100 can also be configured such that a counterclockwise designation is utilized. Moreover, although the foregoing discussion regarding the respective toggling of the rotator assembly 30 between the short mode and open mode is described with respect to a 90° turn of the top cup 20 connected to the rotator assembly 30, it is contemplated that the short sections 102, 118, intermediate sections 106, 122, open sections 110, 126, and stop sections 114, 130 can be configured such that the top cup 20 and connected rotator assembly 30 can be rotated more than 90° or less than 90° to toggle between the short mode and open mode. In some aspects, it is contemplated that the shorting plug 10 can be toggled between the shorted mode and the open mode with a rotational turn between about 25° and about 155° of the top cup 20 (and connected rotator assembly 30), in some other aspects between about 45° and about 145°, and still some other aspects between about 60° and about 120°, although other subranges within these ranges are incorporated.

The top cup 20 and/or cam cup 90 may also have a visual indicator, such as an arrow, line, symbol or the like. For instance, the top cup 20 may contain an arrow that is aligned with another arrow on the cam cup 90. In one aspect, the visual indicator on the top cup 20 may align with the window 28, such that the operator is able to tell the relative location of the window 28 with respect to the desired latch 80*a*, 80*b*. In another aspect, the visual indicator on the top cup 20 is not aligned with the window 28. In another aspect, a top plate 140 contains a visual indicator, which is attached to the top cup 20, such as shown in FIG. 2.

In some aspects, the rotator 31, cam cup 90, top flange 60 and spacer 76 are comprised of an insulative material that has a high strength, stiffness, low coefficient of friction and good wear properties. In some aspects, the insulative material is capable of performing in temperatures between about −20° F. to about 180° F. In some aspects, the insulative material is a plastic, a thermoplastic or the like. In some aspects, the insulative material is natural or white Delrin®.

In some aspects, the cam cup 90 is comprised of an insulative material that is overmolded with a rubber material below the exterior annular ridge 99. In some instances, the capacitor plug 98 comprises a rubber material.

In some aspects, the top cup 20 comprises an insulative material that has a high strength, stiffness, low coefficient of friction and good wear properties. In some aspects, the insulative material is capable of performing in temperatures between about −20° F. to about 180° F. In some aspects, the insulative material is a plastic, a thermoplastic or the like. In some aspects, the insulative material is natural or white Delrin®. In some aspects, the top cup 20 comprises a metal alloy, such as aluminum alloy or the like. In some aspects, the top cup 20 comprises an anodized metal alloy.

In some aspects, the latches 80*a*, 80*b* comprise an insulative material that has a high strength, stiffness, low coefficient of friction and good wear properties. In some aspects, the insulative material is capable of performing in temperatures between about −20° F. to about 180° F. In some aspects, the insulative material is a plastic, a thermoplastic or the like. In some aspects, the insulative material is natural or white Delrin®. In some aspects, the latches 80*a*, 80*b* comprise a metal alloy, such as aluminum alloy or the like. In some aspects, the latches 80*a*, 80*b* comprises an anodized metal alloy. In some aspects, latch 80*a* is an aluminum alloy anodized with a different color than latch 80*b*, such as latch 80*a* anodized the color green to symbolize the shorted mode while latch 80*b* is anodized the color red to symbolize the open mode. Other colors and designations between the shorted mode and open mode are contemplated herein.

Figure 11:
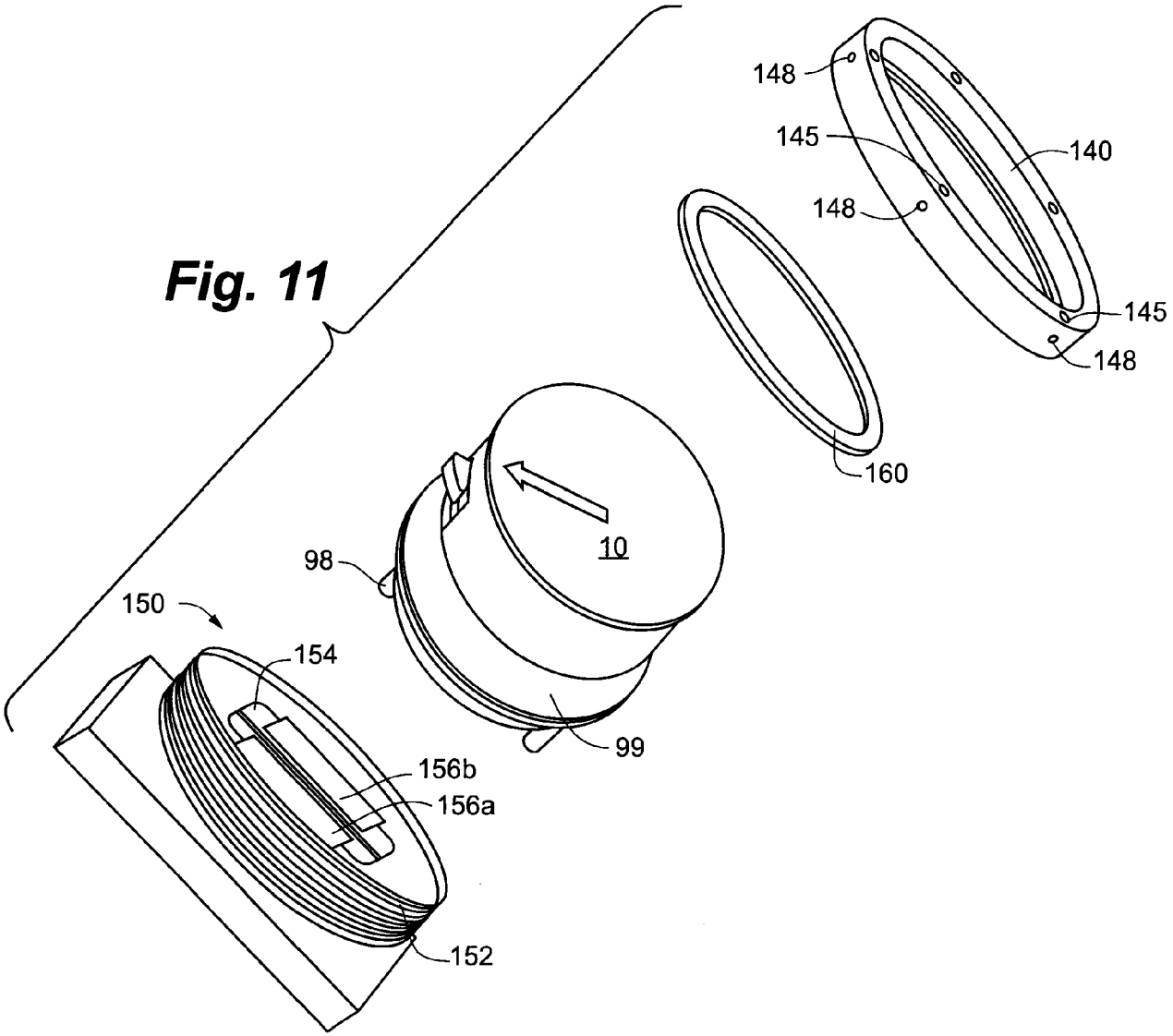
FIG. 11 shows an exploded perspective view of a shorting plug of the present invention operably inserted onto a capacitor, the shorting plug capable of being secured onto the capacitor with a locking ring that operably engages an exterior annular ridge on the shorting plug. Located between the locking ring and exterior annular ridge of the shorting plug, a sealing component or a friction ring may optionally be utilized.
Figure 12B:
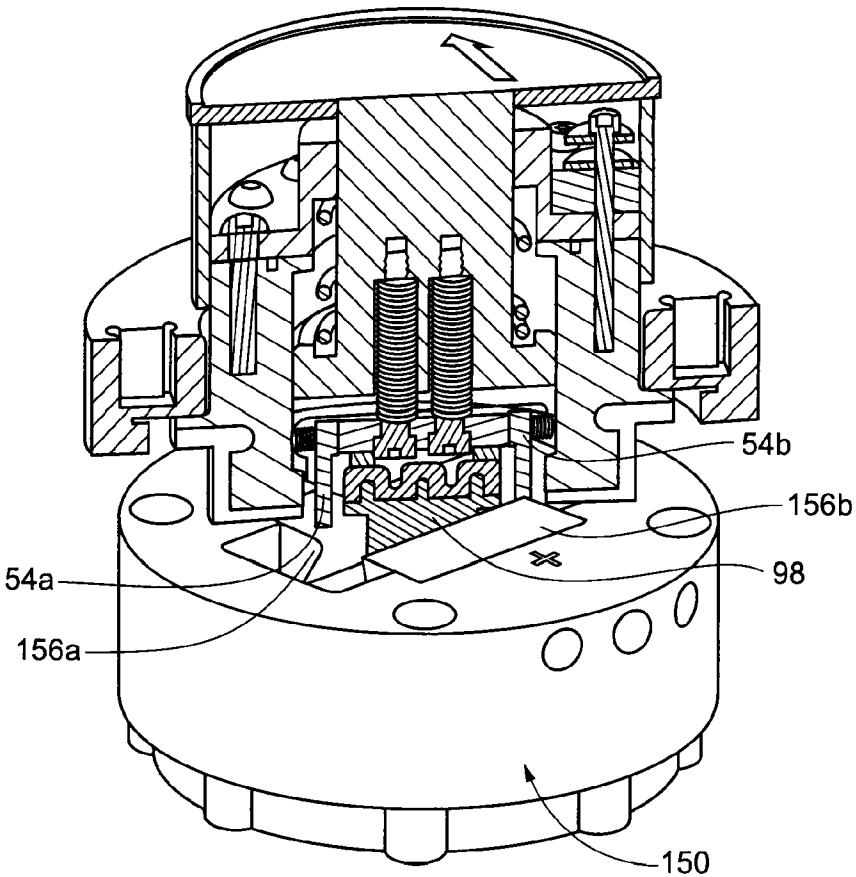
FIG. 12B shows a side cross-sectional representation of the shorting plug of FIG. 12A interfacing with the top portion of a capacitor.
Figure 12A:
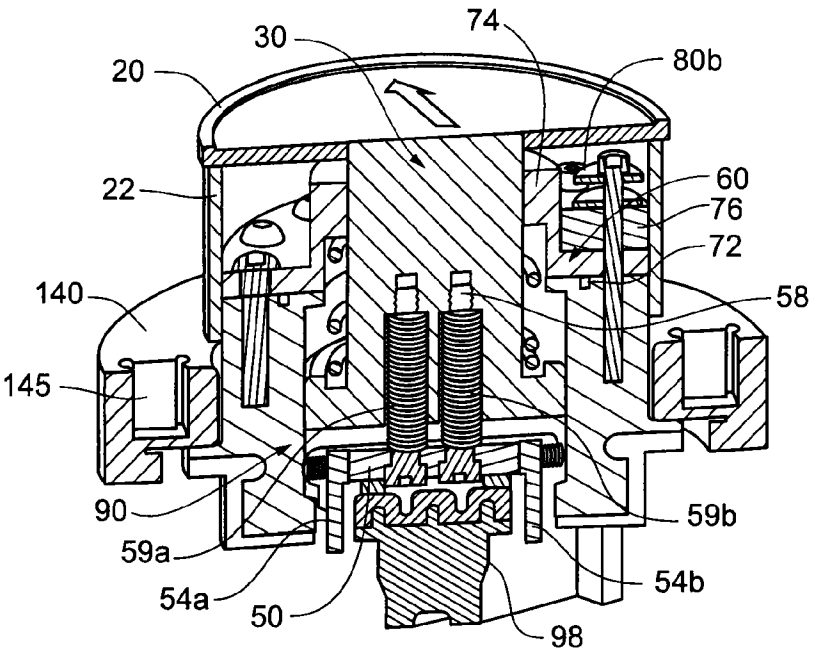
FIG. 12A shows a side cross-sectional representation of a shorting plug of the present invention with a rocking ring operably engaging an exterior annular ridge on the shorting plug.

Referring now to FIGS. 11-12B, in some aspects, the cam cup 90 contains an exterior annular ridge 99. The exterior annular ridge 99 may be used to secure the shorting plug 10 between a receiving portion 152 proximately located the top portion of header assembly 150 and a locking ring 140. In this aspect, the exterior annular ridge 99 is located between the receiving portion 152 of the header assembly 150 that receives the locking ring 140, which can be secured down onto the top portion of header assembly 150. In some aspects, the locking ring 140 threads down onto the receiving portion 152 of the header assembly 150, such that the exterior annular ridge 99 is sandwiched between the locking ring 140 and the top edge of the receiving portion 152 of the header assembly 150 providing a weather tight seal. The configuration of the locking ring 140, exterior annular ridge 99, and receiving portion 152 may also contain a sealing component 160, such as an O-ring or a Teflon ring, between the exterior annular ridge 99 and the receiving portion 152 of the capacitor 150 and/or between the exterior annular ridge 99 and the locking ring 140 to provide additional weather tight seal protection.

In some aspects, the cam cup 90 contains rubber overmolded a thermoplastic material, such that the rubber material overmolds the cam cup 90 in the area below the exterior annular ridge 99, including the bottom portion of the exterior annular ridge 99. In this aspect, the shorting plug 10 is capable of being secured to the receiving portion 152 of the header assembly 150 by a locking ring 140 that operably engages the exterior annular ridge 99. A sealing component 160, such as a teflon ring or O-ring may be provided between the top portion of the exterior annular ridge 99 and the locking ring 140 to provide a weather tight seal. The rubber material on the bottom portion of the exterior annular ridge 99 serves as a seal between the cam cup 90 and the header assembly 150. In this configuration, the O-rings 72, 76 and exterior seals provided proximate the exterior annular ridge 99 provide for a watertight seal of the electrical contacts 54*a*, 54*b* and current bridging bar 50 with respect to the receptive capacitor. In some aspects, these seals are capable of withstanding 1 meter of water, or up to about 2 psi of water. These seals also provide the ability to withstand other environmental materials, such as rain, dust, dirt, humidity, and the like.

In some aspects, such as shown in FIG. 12B, when the shorting plug 10 is operably engaged with the header assembly 150 of a circuit, capacitor or energy system, such as a pulsed power system, a plug receiver 154 operably receives the plug 98 of the shorting plug, such that the plug 98 separates a pair of electrodes 156*a*, 156*b* on the header assembly 150 that are electrically connected to the electrical system, such as a capacitor. In this configuration, apertures 91*a*, 91*b* on the cam cup 90 operably align with electrodes 156*a*, 156*b* such that electrical contacts 54*a*, 54*b* are capable of operably engaging the electrodes 156*a*, 156*b*, respectively, during the shorted mode of operation.

In some aspects, the locking ring 140 may contain one or more tool engaging apertures 145 to allow the locking ring 140 to be operably engaged with the receiving portion 152. The locking ring 140 may also contain one or more water-drain holes 148, such that any moisture that accumulates in the tool engaging apertures 145 and/or such that any debris or foreign matter such as dirt, dust, sand or the like, is able to be flushed out of the tool engaging apertures 145.

The above disclosure is intended to be illustrative and not exhaustive. This description will suggest many variations and alternatives to one of ordinary skill in the art without departing from the scope of the present invention. All these alternatives and variations are intended to be included within the scope of the attached claims. Those familiar with the art may recognize other equivalents to the specific embodiments described herein which equivalents are also intended to be encompassed by the claims attached hereto.

The invention claimed is:

1. A shorting plug comprising:

a rotator assembly having a first electrode and a second electrode;

a cam housing at least partially containing therein the rotator assembly and having a first electrode aperture and a second electrode aperture; and a cam rail located within the cam housing, the cam rail structured to operably engage the rotator assembly in a shorted configuration such that the first and second electrodes are configured to be extended out of the cam housing through the first and second electrode apertures, and the cam rail structured to operably engage the rotator assembly in an open configuration such that the first and second electrodes are configured to be retracted within the first and second electrode apertures and into the cam housing.

2. The shorting plug of claim 1, wherein the rotator assembly is capable of at least partially rotating within the cam housing.

3. The shorting plug of claim 1, the rotator assembly further having a bridging bar that electrically connects the first electrode and the second electrode.

4. The shorting plug of claim 1, the cam housing having a cylindrical side wall and the cam rail located proximate the cylindrical side wall.

5. The shorting plug of claim 4, the cam rail having at least a first section, a second section, and a third section, the second section intermediate the first section and the third section, wherein the rotator assembly operably engages the first section in the shorted configuration and the third section in the open configuration.

6. The shorting plug of claim 5, wherein the first section and the third section of the cam rail are separated a rotational distance of between about 30 degrees and about 150 degrees.

7. The shorting plug of claim 5, wherein the first section and the second section of the cam rail are separated a first rotational distance of about 45 degrees, the second section and the third section of the cam rail are separated a second rotation distance of about 45 degrees, and the first section and the third section of the cam rail are separate a third rotational distance of about 90 degrees.

8. The shorting plug of claim 1, further comprising a spring means for providing a downward vertical force on the rotator assembly towards a bottom portion of the cam housing having the first and second electrode apertures.

9. The shorting plug of claim 1, further comprising a cap housing connected to the rotator assembly.

10. The shorting plug of claim 9, wherein the cap housing and the rotator assembly are capable of at least partially rotating with respect to the cam housing and the rotator assembly capable of at least partially rotating within the cam housing.

11. The shorting plug of claim 10, further comprising at least one latch mechanism connected to the cam housing, the latch mechanism capable of operably engaging a window located in the cap housing.

12. The shorting plug of claim 10, further comprising a first latch connected to the cam housing at a first position, and a second latch connected to the cam housing at a second position.

13. The shorting plug of claim 12, wherein the first latch operably engages a window located in the cap housing in the shorted configuration and the second latch operably engages the window located in the cap housing in the open configuration.

14. The shorting plug of claim 13, wherein the first latch has a first visual indicator that indicates to an operator that the shorting plug is in the shorted configuration.

15. The shorting plug of claim 12, wherein the first position of the first latch is in a first horizontal plane and the second position of the second latch is in a second horizontal plane.

16. The shorting plug of claim 12, further comprising a first spring means operably connected to the first latch for providing a first radial horizontal force on the first latch.

17. The shorting plug of claim 16, further comprising a second spring means operably connected to the second latch for providing a second radial horizontal force on the second latch.

18. A shorting plug comprising:

a cam housing comprising a bottom portion having a first electrode aperture and a second electrode aperture therein, at least one sidewall, and a top portion having an actuation aperture therein, wherein the bottom portion, the at least one side wall and the top portion define an interior space therein;

a cam rail located within the cam housing proximate the side wall, the cam rail having at least a first section and a second section spaced apart by a rotational distance; and a rotator assembly having a first electrode electrically connected to a second electrode, the rotator assembly at least partially contained within the interior space and at least partially rotatable within the interior space along the cam rail between the first and second sections of the cam rail;

wherein the first and second electrodes are extended from the first and second electrode apertures when the rotator assembly is operably engaged with the first section of the cam rail and the first and second electrodes are retracted within the interior space of the cam housing when the rotator assembly is operably engaged with the second section of the cam rail.

19. The shorting plug of claim 18, further comprising a cap housing having at least one sidewall and a top portion, the sidewall having at least one window therein, and the top portion connected to the rotator assembly such that the cap housing is capable of at least partially rotating in conjunction with the rotator assembly.

20. The shorting plug of claim 19, further comprising a first latch operably attached to the top portion of the cam housing at a first position, wherein the first latch is capable of operably engaging the window when the rotator assembly operably engages the first section of the cam rail.

21. The shorting plug of claim 20, further comprising a second latch operably attached to the top portion of the cam housing at a second position, wherein the second latch is capable of operably engaging the window when the rotator assembly operably engages the second section of the cam rail.

22. The shorting plug of claim 21, wherein the first position of the first latch is in a first horizontal plane and the second position of the second latch is in a second horizontal plane.

23. The shorting plug of claim 21, wherein the first latch and the second latch each contain a visual indicator, the visual indicator on the first latch indicating a shorted mode of operation such that the rotator assembly is operably engaged with the first section of the cam rail and the visual indicator on the second latch indicating an open mode of operation such that the rotator assembly is operably engaged in the second section of the cam rail.

24. The shorting plug of claim 19, the cam rail having a third section located between the first and second sections, the second section located a first vertical distance from the first section away from the bottom portion of the cam housing, and the third section located a second vertical distance from the first section away from the bottom portion of the cam housing, and wherein the second vertical distance is greater than the first vertical distance.

25. The shorting plug of claim 19, further comprising a vertical force means for providing a downward vertical force onto the rotator assembly towards the bottom portion of the cam housing.

26. A method of operating a shorting plug on a pulsed power system from a shorted operational mode to an open operational mode, the shorting plug comprising a cam housing and a rotator assembly having a current bridging bar electrically connected to a first and second electrode, the rotator assembly at least partially rotationally contained within the cam housing and capable of operably engaging a cam rail within the cam housing, the cam rail having a first section corresponding to the shorted operational mode and a second section corresponding to the open operational mode, the rotator assembly having a downward vertical force applied towards a bottom portion of the cam housing, the rotator assembly connected to a cap housing having a window, a first latch connected to the cam housing having a first horizontal force, a second latch connected to the cam housing having a second horizontal force, the first latch capable of operably engaging the window during the shorted operational mode, and the second latch capable of operably engaging the window during the open operational mode, the method comprising depressing the first latch into the cap housing in a direction opposite the first horizontal force;

lifting the cap housing in an upward vertical direction opposite the downward vertical force being applied towards the bottom portion of the cam housing;

rotating the cap housing such that the rotator assembly within the cam housing operably engages from the first section to the second section; and releasing the cap housing allowing the cap cover to move in a downward vertical direction by the downward vertical force being applied to the rotator assembly such that the second latch operably engages the window.

27. A method of operating a shorting plug on a pulsed power system from an open operational mode to a closed open operational mode, the shorting plug comprising a cam housing having a rotator assembly having a current bridging bar electrically connected to a first and second electrode, the rotator assembly at least partially rotationally contained within the cam housing and capable of operably engaging a cam rail within the cam housing, the cam rail having a first section corresponding to the shorted operational mode and a second section corresponding to the open operational mode, the rotator assembly having a downward vertical force applied towards a bottom portion of the cam housing, the rotator assembly connected to a cap housing having a window, a first latch connected to the cam housing having a first horizontal force, a second latch connected to the cam housing having a second horizontal force, the first latch capable of operably engaging the window during the shorted operational mode, and the second latch capable of operably engaging the window during the open operational mode, the method comprising depressing the second latch into the cap housing in a direction opposite the second horizontal force;

lifting the cap housing in an upward vertical direction opposite the downward vertical force being applied towards the bottom portion of the cam housing;

rotating the cap housing such that the rotator assembly within the cam housing operably engages from the second section to the first section; and releasing the cap housing allowing the cap cover to move in a downward vertical direction by the downward vertical force being applied to the rotator assembly such that the first latch operably engages the window.

* * * * *